US008220518B2

(12) United States Patent
Judkins

(10) Patent No.: US 8,220,518 B2
(45) Date of Patent: Jul. 17, 2012

(54) EXPANDABLE AND CONTRACTABLE WINDOW COVERING

(75) Inventor: Ren Judkins, Pittsburgh, PA (US)

(73) Assignee: Hunter-Douglas, Inc., Pearl River, NY (US)

( * ) Notice: Subject to any disclaimer, the term of this patent is extended or adjusted under 35 U.S.C. 154(b) by 48 days.

(21) Appl. No.: 12/582,413

(22) Filed: Oct. 20, 2009

(65) Prior Publication Data

US 2011/0088851 A1 Apr. 21, 2011

(51) Int. Cl.
*E06B 9/24* (2006.01)

(52) U.S. Cl. ..... 160/84.05; 160/35; 160/34

(58) Field of Classification Search ..... 160/84.01, 160/84.05, 34, 35, 32, 84.04
See application file for complete search history.

(56) References Cited

U.S. PATENT DOCUMENTS

| | | | | |
|---|---|---|---|---|
| 1,676,500 | A * | 7/1928 | McGinnis | 160/33 |
| 2,201,356 | A | 5/1940 | Terrell | |
| 2,876,834 | A * | 3/1959 | Walker | 160/168.1 R |
| 3,487,875 | A | 1/1970 | Shukat et al. | |
| 4,069,857 | A | 1/1978 | Brookshire | |
| 4,388,354 | A | 6/1983 | Suominen | |
| 4,397,346 | A | 8/1983 | Chumbley et al. | |
| D277,061 | S | 1/1985 | Picoy | |
| 4,542,602 | A | 9/1985 | Hoverson | |
| 4,603,072 | A | 7/1986 | Colson | |
| 4,677,012 | A | 6/1987 | Anderson | |
| 4,732,630 | A | 3/1988 | Schnebly | |
| 4,861,404 | A | 8/1989 | Neff | |
| 4,921,032 | A | 5/1990 | May | |
| 5,090,098 | A | 2/1992 | Seveik et al. | |
| 5,129,440 | A | 7/1992 | Colson | |
| 5,158,632 | A * | 10/1992 | Colson et al. | 156/197 |
| 5,176,192 | A * | 1/1993 | Judkins et al. | 160/84.04 |
| 5,228,936 | A | 7/1993 | Goodhue | |
| 5,313,998 | A | 5/1994 | Colson et al. | |
| 5,339,882 | A | 8/1994 | Judkins | |
| 5,425,408 | A | 6/1995 | Colson | |

(Continued)

FOREIGN PATENT DOCUMENTS

EP 0427477 A2 5/1991

(Continued)

OTHER PUBLICATIONS

Roman Shades, seamstobe.com/Romanshades.htm, at least as early as May 26, 2009, 2 pages.

(Continued)

*Primary Examiner* — Blair M. Johnson
(74) *Attorney, Agent, or Firm* — Dority & Manning, P.A.

(57) ABSTRACT

An expandable and contractable shade assembly includes a plurality of closed cell structures aligned vertically one above another with juncture lines defined between adjacent structures. A lift system is configured for vertically drawing the closed cell structures from the fully expanded configuration into a fully contracted configuration, and includes a plurality of lift cords that are attached to back faces of the closed cell structures and lie along a vertical line of action rearward of the closed cell structures. In the fully contracted configuration of the shade assembly, the closed cell structures collapse into a flat profile and hang from the lift cords in a vertical and adjacently disposed orientation whereby upper edges of the collapsed closed cell structures are adjacent and oriented in an upward vertical direction, and bottom edges of the collapsed closed cell structures are adjacent and oriented in a downward vertical direction.

28 Claims, 24 Drawing Sheets

U.S. PATENT DOCUMENTS

| | | | | |
|---|---|---|---|---|
| 5,503,210 | A | 4/1996 | Colson et al. | |
| 5,547,006 | A | 8/1996 | Auger | |
| 5,560,976 | A | 10/1996 | Huang | |
| 5,566,735 | A | 10/1996 | Jelic | |
| 5,620,035 | A | 4/1997 | Judkins | |
| 5,649,583 | A | 7/1997 | Hsu | |
| 5,690,156 | A | 11/1997 | Ruggles | |
| 5,691,031 | A | 11/1997 | Swiszcz et al. | |
| 5,701,940 | A | 12/1997 | Ford et al. | |
| 5,706,876 | A | 1/1998 | Lysyj | |
| 5,746,266 | A | 5/1998 | Colson et al. | |
| 5,753,338 | A | 5/1998 | Jelic et al. | |
| 5,787,951 | A | 8/1998 | Tonomura et al. | |
| 6,033,504 | A | 3/2000 | Judkins | |
| 6,068,039 | A | 5/2000 | Judkins | |
| 6,257,300 | B1 | 7/2001 | Brownlie | |
| 6,497,264 | B1 | 12/2002 | Paskevicius | |
| 6,520,238 | B2 | 2/2003 | Allsopp | |
| 6,572,725 | B2 | 6/2003 | Goodhue | |
| 6,640,867 | B1 * | 11/2003 | Pallotta et al. | 160/84.04 |
| 6,662,845 | B1 * | 12/2003 | Palmer | 160/84.01 |
| 6,767,615 | B1 | 7/2004 | Judkins et al. | |
| D498,105 | S | 11/2004 | Tyner | |
| 6,932,138 | B2 | 8/2005 | Yu et al. | |
| 6,988,526 | B2 | 1/2006 | Judkins | |
| 7,021,359 | B2 | 4/2006 | Yu et al. | |
| 7,124,802 | B2 | 10/2006 | Sudano | |
| 7,159,364 | B2 * | 1/2007 | Rillie | 52/200 |
| 7,159,634 | B1 | 1/2007 | Judkins | |
| 7,275,580 | B2 | 10/2007 | Yu et al. | |
| 7,290,582 | B2 | 11/2007 | Lin | |
| 7,353,856 | B2 | 4/2008 | Pon et al. | |
| D568,082 | S | 5/2008 | Bohlen | |
| 7,415,845 | B1 | 8/2008 | Graichen | |
| 7,481,076 | B2 | 1/2009 | Windisch et al. | |
| 7,513,292 | B2 | 4/2009 | Auger et al. | |
| 7,523,777 | B2 | 4/2009 | Kim | |
| 2006/0027336 | A1 | 2/2006 | Lin | |
| 2006/0219369 | A1 | 10/2006 | Yu et al. | |
| 2006/0225846 | A1 | 10/2006 | Marusak et al. | |
| 2006/0243395 | A1 | 11/2006 | Liang | |
| 2006/0254726 | A1 | 11/2006 | Lin | |
| 2007/0023151 | A1 | 2/2007 | Judkins | |
| 2007/0074826 | A1 | 4/2007 | Jelic et al. | |
| 2007/0175593 | A1 | 8/2007 | Lin | |
| 2008/0251216 | A1 * | 10/2008 | Hsu | 160/84.01 |
| 2011/0088851 | A1 * | 4/2011 | Judkins | 160/84.02 |

FOREIGN PATENT DOCUMENTS

| | | | |
|---|---|---|---|
| WO | WO 88/07345 | A1 | 10/1988 |
| WO | WO 93/07353 | A1 | 4/1993 |

OTHER PUBLICATIONS

Understand Roman Shades, terrelldesigns.com, at least as early as May 26, 2009, 4 pages.

* cited by examiner

EXPANDABLE AND CONTRACTABLE WINDOW COVERING

FIELD OF THE INVENTION

The present invention relates generally to expandable and contractable coverings for windows or other openings in a building or other structure. More particularly, the invention relates to a type of cellular shade covering that has the appearance of a shade referred to in the art as a "Roman shade" wherein a plurality of horizontally disposed and vertically aligned tubular structures are presented in an expanded configuration of the covering and collapse as the covering is drawn into a contracted configuration.

BACKGROUND

Cellular shades have become a popular type of window covering in residential and commercial applications. These shades are aesthetically attractive and also provide improved insulation across a window or other type of opening due to their cellular construction. Cellular shades have assumed various forms, including a plurality of longitudinally extending tubes made of a flexible or semi-rigid material. The cellular shade is extended across an architectural opening, for example mounted at the top of a window or door frame, and the tubes cover the opening in the expanded state of the shade. The shade can be retracted or drawn into a contracted state wherein the tubes collapse into a stack. When viewed from the front (i.e., interior of a room) this stack may have an appearance similar to stacked slats of a Venetian blind. Typically, the width of the stack is half of the overall perimeter of the cell and projects from the glass side to the room side since the cords are normally disposed through the connecting point between each cell.

Reference is made to U.S. Pat. No. 5,313,998; U.S. Pat. No. 5,129,440; U.S. Pat. No. 5,746,266; and US Pat. Pub. No. 2007/0074826 for various examples of expandable and contractable cellular shades.

The design emphasis in home and building structures has maintained pressure on the industry to create unique aesthetically attractive coverings for architectural openings which also have utilitarian functions, such as insulating the opening to minimize the loss of heat therethrough. Although the introduction of cellular shades has greatly benefited the industry in this regard, to some the appearance of conventional cellular shades in the fully deployed position is too angular with defining fold lines that are too close together. If the pleats are made larger, the contracted (i.e. raised) configuration is not aesthetically pleasing, because it is too wide and projects too far into the room. On the other hand Roman shades, particularly with shades having "soft" or billowing front faces are so commonplace that they are falling out of fashion. In addition, when more than one layer is used they stack inside of themselves which results in a deeper stack dimension (horizontal aspect) that must be accommodated for in the depth of the frame structure in which the shade is mounted, which can be problematic for a number of reasons.

The present invention provides a unique type of cellular shade with a Roman appearance that includes desired beneficial functional aspects and aesthetic features of both types of the conventional shades, yet provides an improved and aesthetically pleasing configuration in the fully contracted configuration of the shade. For example, in one embodiment, the shade product of the present disclosure can provide energy saving and/or light diffusion characteristics of cellular shades in combination with a novel and unique Roman-like appearance that includes a unique crease structure and method of stacking.

SUMMARY

Various features and advantages of the invention will be set forth in part in the following description, or may be obvious from the description, or may be learned through practice of the invention.

In accordance with certain embodiments of the present invention, an expandable and contractable shade assembly is provided, which may be used as a shade or covering in a window, door, or any other type of architectural opening in a building or other structure. The shade assembly includes a plurality of closed cell structures that are disposed longitudinally along a width dimension of the shade assembly so as to extend across the window or other opening. The closed cell structures are aligned vertically one above another with juncture lines defined between adjacent ones of the structures. These juncture lines may or may not be visible from the front of the shade assembly depending on the desired appearance of the front face of the cell structures.

The cell structures are "closed" in that they have an unbroken, continuous, closed circumferential wall. As explained in greater detail herein, this wall may be defined by a single piece of material that is joined at its edges (e.g., a loop configuration), or by multiple pieces of material that are joined at various locations, such as at the juncture lines between adjacent cells.

Each of the closed cell structures has a back face and a front face, which are separated by the juncture lines between the cells. In a fully expanded configuration of the shade assembly, each of the closed cell structures has a cross-sectional profile such that the back face defined at one side of the juncture lines has an essentially flat vertical profile, and the front face defined at the opposite side of the juncture lines can also have a flat profile or may have a "soft" billowed or drooping profile depending on the application.

A lift system is configured for vertically drawing the closed cell structures from their fully expanded configuration into a fully contracted configuration of the shade assembly. In a particular embodiment, the lift system includes a plurality of lift cords that are disposed in a vertical line of action rearward of (i.e., behind) the back face of the closed cell structures. In this embodiment, the lift cords do not extend through the closed cell structures, but lie outside of and behind the cells. The lift cords are engaged with the back face of the closed cell structures at an attachment location that is between the juncture lines. In a particular embodiment, this attachment location is at about the mid-point of the back face and defines a fold line for the cell structures in the collapsed state.

The lift cords can be connected to the back face of the closed cell structures using various techniques and configurations. For instance, in one embodiment, each of the closed cells can include a tab through which the lift cords pass. Alternatively, a hook ring or loop can be provided on the back face of the closed cells for connecting to the lift cords. In still another embodiment, holes or passageways may be drilled on the medial side of the back crease (slightly forward of the back face) to connect the cord to the shade and to cause the cell structures to stack in a particular way in the collapsed state.

In the fully contracted configuration of the shade assembly, the closed cell structures collapse into a flat profile with the front faces against each other and the back faces against each other. The plurality of collapsed cell structures are drawn together and hang vertically from the lift cords, whereby upper edges of the collapsed closed cell structures are adjacent and oriented in an upward vertical direction, and bottom edges of the collapsed closed cell structures are adjacent and oriented in a downward vertical direction. In this configuration, when viewed from the front of the shade assembly, the gathered and collapsed cell structures appear to hang vertically from out of a head rail. This presents a unique and aesthetically pleasing appearance, particularly for larger cellular structures. In addition, the depth of the vertically disposed and collapsed cell structures in the fully contracted configuration of the shade assembly corresponds essentially to the thickness of the vertical stack, which is far less than if the collapsed stack was oriented horizontally as with conventional cellular shade designs and is even smaller than a conventional double-layer Roman shade which typically would have twice as many layers in the stack. Thus, the shade product does not project into a room when in a partially or completely collapsed state. In the past, for instance, cellular shades containing relatively large cells would project into the room when in the collapsed state causing the shade to look out of place, causing the shade to interfere with the drapes, and/or to cause the furniture to be rearranged so as not to contact the shade.

In a unique embodiment, a crease is defined in the front face of each of the closed cell structures at about the mid-point of the face between the juncture lines. This crease causes the cells to essentially expand outwardly in the expanded configuration of the shade assembly resulting in a more aesthetically pleasing appearance. The crease also defines the bottom edges of the collapsed cell structures in the contracted configuration of the shade assembly.

The length and flexibility of the front face of the cell structures between the juncture lines provides the desired look to the shade assembly. A greater length of material results in a greater droop or billow of the cell structure. In a unique embodiment, the length of the front face is greater between the juncture lines as compared to the back face to such a degree that the front face droops below the juncture line between the respective cell and the immediately adjacent (lower) cell.

The difference in length between the front face and the back face of each cell can create a three-dimensional appearance. Because the cells are relatively large, gravity shapes the front face into an attractive curved shape. It should be understood, however, that the cell structures can also be made such that the front face is the same length as the back face. In this case, the front face hangs flat. The shade may also fold up in a unique way that leaves the stack hanging vertically from the back face creases or tabs.

As described above, the lift cords may be engaged with the back faces of the cell structures by various means. In a particularly unique embodiment, each cell includes a tab extending transversely from about the mid-point of the back face, with the lift cords running through the tabs, for example through holes or grommets in the tabs. In this embodiment, each closed cell structure may be formed by a single piece of flexible or semi-rigid material joined at edges to define a closed loop, with the joined edges defining a respective tab.

In an alternate embodiment, the closed cell structures may be defined by multiple pieces of material. For example, the front face of the closed cell structures may be formed from a first material piece, and the back face formed from a separate second material piece or from a second material piece and a third material piece. In this embodiment, the tab on the back face may be defined by a folded or pleated section of the second material piece or may be located where two back pieces are brought together. The front and back material pieces may be joined at the juncture lines to define a closed cell.

Other cell structures which may be incorporated into the shade assembly of the present disclosure are described in U.S. Pat. No. 5,620,035, which is incorporated herein by reference.

With still a further unique embodiment, the first material piece may be common to a plurality of the closed cell structures such that a single material piece defines the front faces for multiple or all of the cells. Likewise, the second material piece may be common to a plurality of the closed cell structures such that a single material piece defines the back faces for multiple or all of the cells.

The shade assembly further includes a headrail that incorporates various components of the lift system. The headrail may, in one embodiment, optionally include an internal channel into which the upper edges of the collapsed closed cell structures are drawn and maintained in their adjacent and vertically oriented configuration in the fully contracted configuration of the shade assembly. This channel may be defined by downwardly extending guide members and, in one embodiment, has a generally rectangular cross-sectional profile.

In a particularly unique embodiment, the internal channel has a cross-sectional profile that tapers from the open end of the channel to a closed end of the channel. The taper may be defined by one or both of the guide members being angled with respect to vertical. For example, in one embodiment, the front guide member may be vertical, and the back guide member may be angled towards the front guide member. The tapered channel has an initial width at the open end to ensure that all of the gathered top edges of the collapsed cell structures are easily drawn into the channel. The taper then serves to ensure that the top edges are maintained at an essentially vertical orientation as they are drawn further into the channel. The channel has a width at the closed end that is at least as great as the thickness of the stack of vertically oriented collapsed cells without compressing the cells so as to ensure that the cells do not become wedged into the channel and are easily released when the shade is lowered.

Aspects of the invention are described in greater detail below with reference to particular embodiments illustrated in the appended figures.

DETAILED DESCRIPTION

Figure 1:
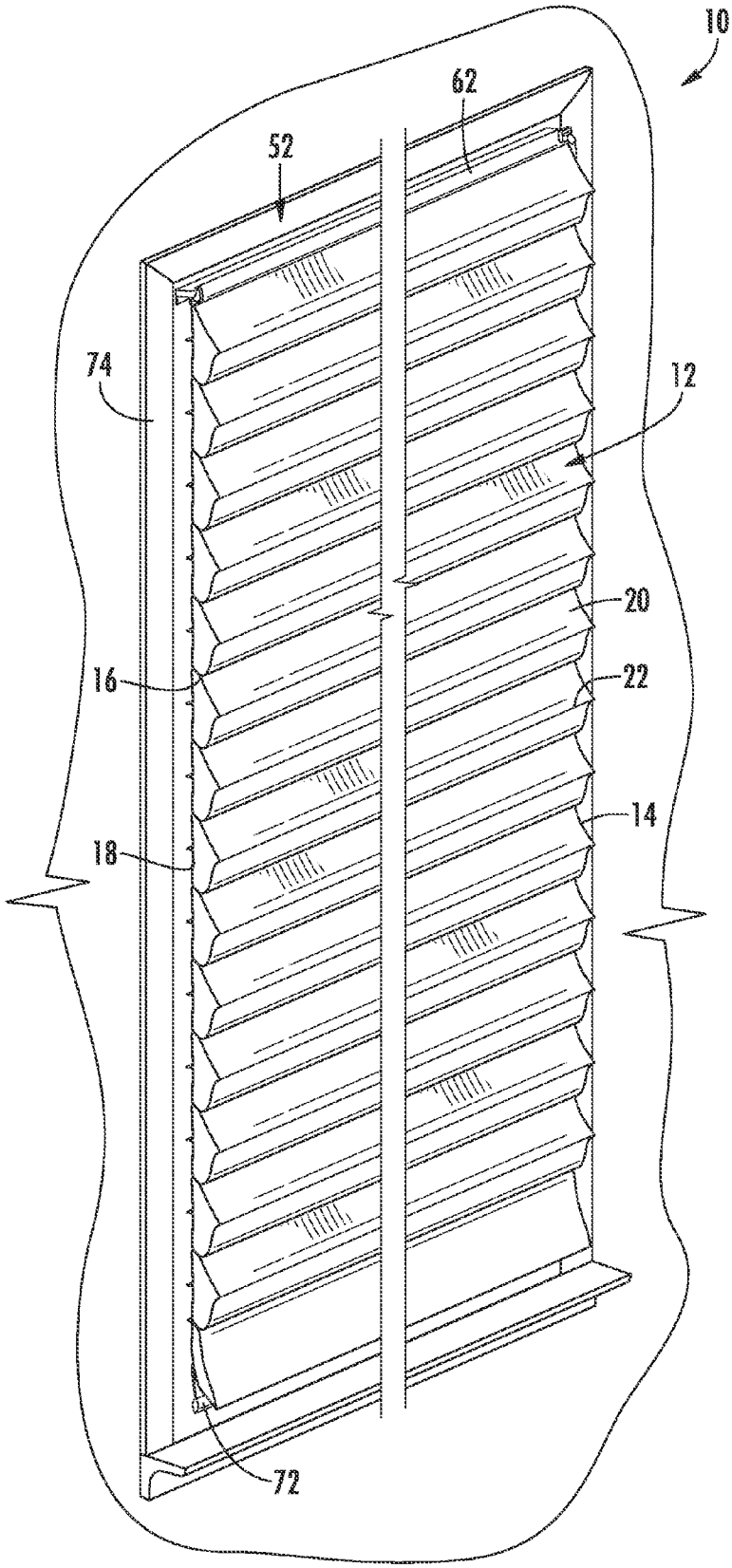
FIG. 1 is a perspective fragmented view of an embodiment of a shade assembly in accordance with aspects of the invention illustrated in a fully expanded configuration as a window covering.

Reference will now be made to various embodiments of the present invention, examples of which are illustrated in the drawings. It should be appreciated that each embodiment is provided by way of explanation of the invention, and not meant as a limitation of the invention. For example, features illustrated or described as part of one embodiment may be used with another embodiment to yield still a further embodiment. It is intended that the invention include these and other modifications and variations as come within the scope and spirit of the invention.

Figure 2:
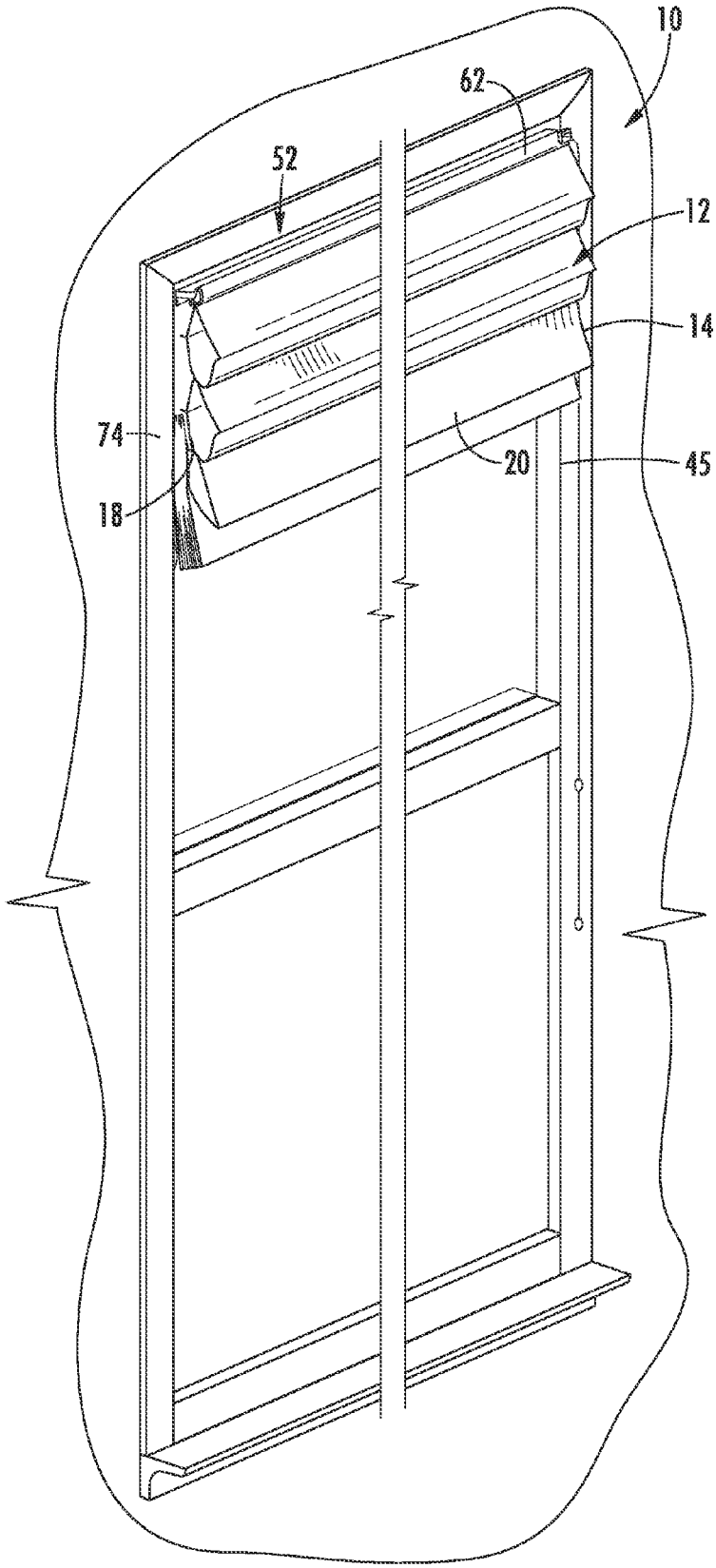
FIG. 2 is a perspective fragmented view of the shade assembly of FIG. 1 in a raised partially contracted configuration.
Figure 3:
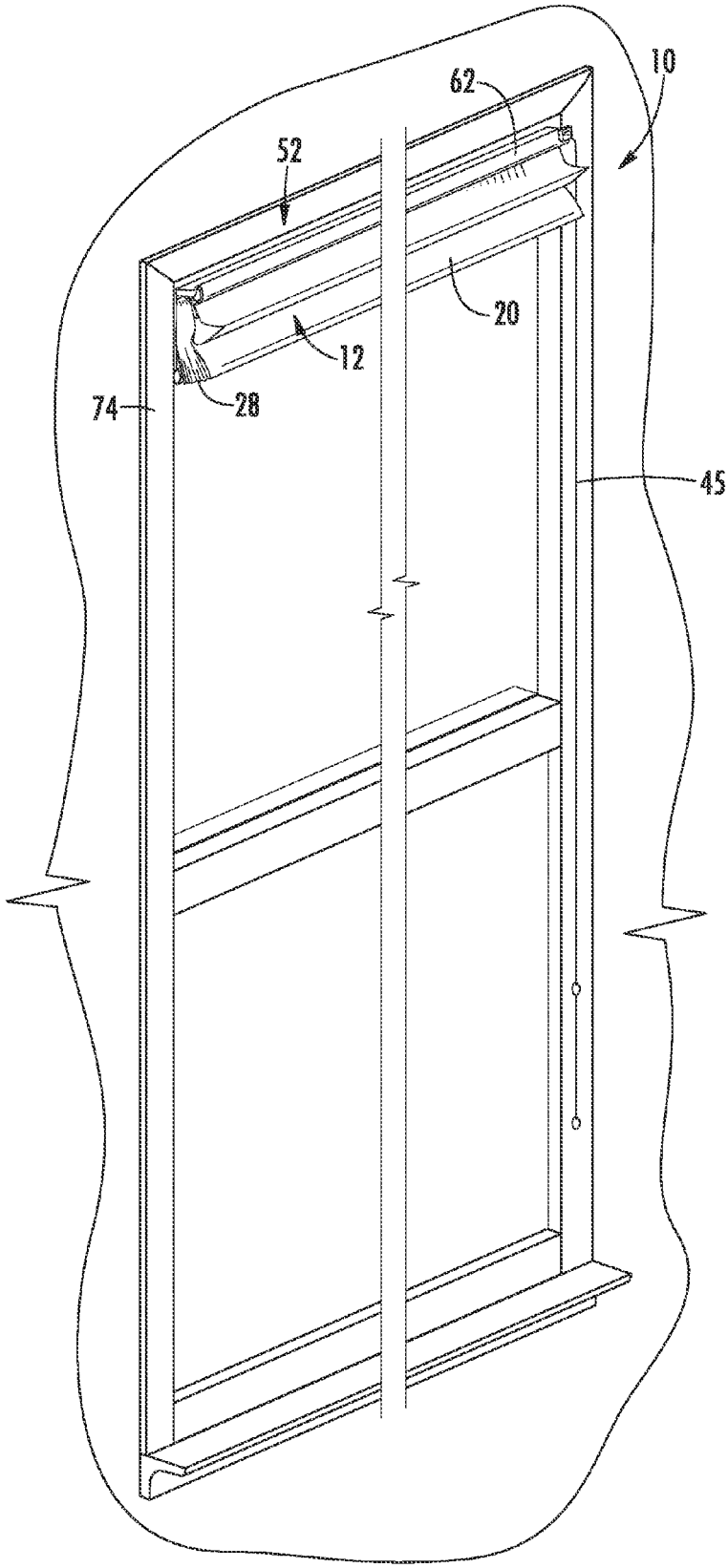
FIG. 3 is a perspective fragmented view of the shade assembly of FIG. 1 in a raised fully contracted configuration.

Referring to FIGS. 1 through 3, an expandable and contractable shade assembly 10 is provided as a covering for a window or other opening defined by a frame 74, as commonly understood in the art. It should be readily appreciated that the shade assembly 10 is not limited in its particular use as a window or door shade or covering, and may be used in any application as a covering, partition, shade, and the like, in any type of architectural opening in a building or structure. The shade assembly 10 is illustrated herein as a window shade for sake of convenience.

Referring to the various figures in general, the shade assembly 10 includes a plurality of closed cell structures 12 that are disposed longitudinally along a width dimension of the shade assembly 10 so as to extend across the window, as particularly illustrated in FIGS. 1 through 3. The closed cell structures 12 are aligned vertically one above another with juncture lines 16 defined between adjacent cell structures 12. As described in greater detail below, depending on the configuration of a front face 20 of each of the cell structures 12, the junction lines 16 may or may not be visible when viewed from a front side of the shade assembly 10.

As depicted in the various figures, each of the cell structures 12 is "closed" in that the structure is defined by a continuous, unbroken circumferential wall. The cell structures 12 are formed from a material or fabric that may be flexible or semi-rigid. A "flexible" material is capable of being folded or flexed, and includes such materials as woven or non-woven fabrics, vinyl or film sheets, cords of natural or synthetic fibers, monofilaments, and the like. A "semi-rigid" material is somewhat stiffer, but is still flexible or foldable to some degree. Examples of such materials include resin reinforced fabrics, polyvinyl chloride, and so forth. It should be readily appreciated that the present invention is not limited to the type of material used to form the cell structures.

Figure 4:
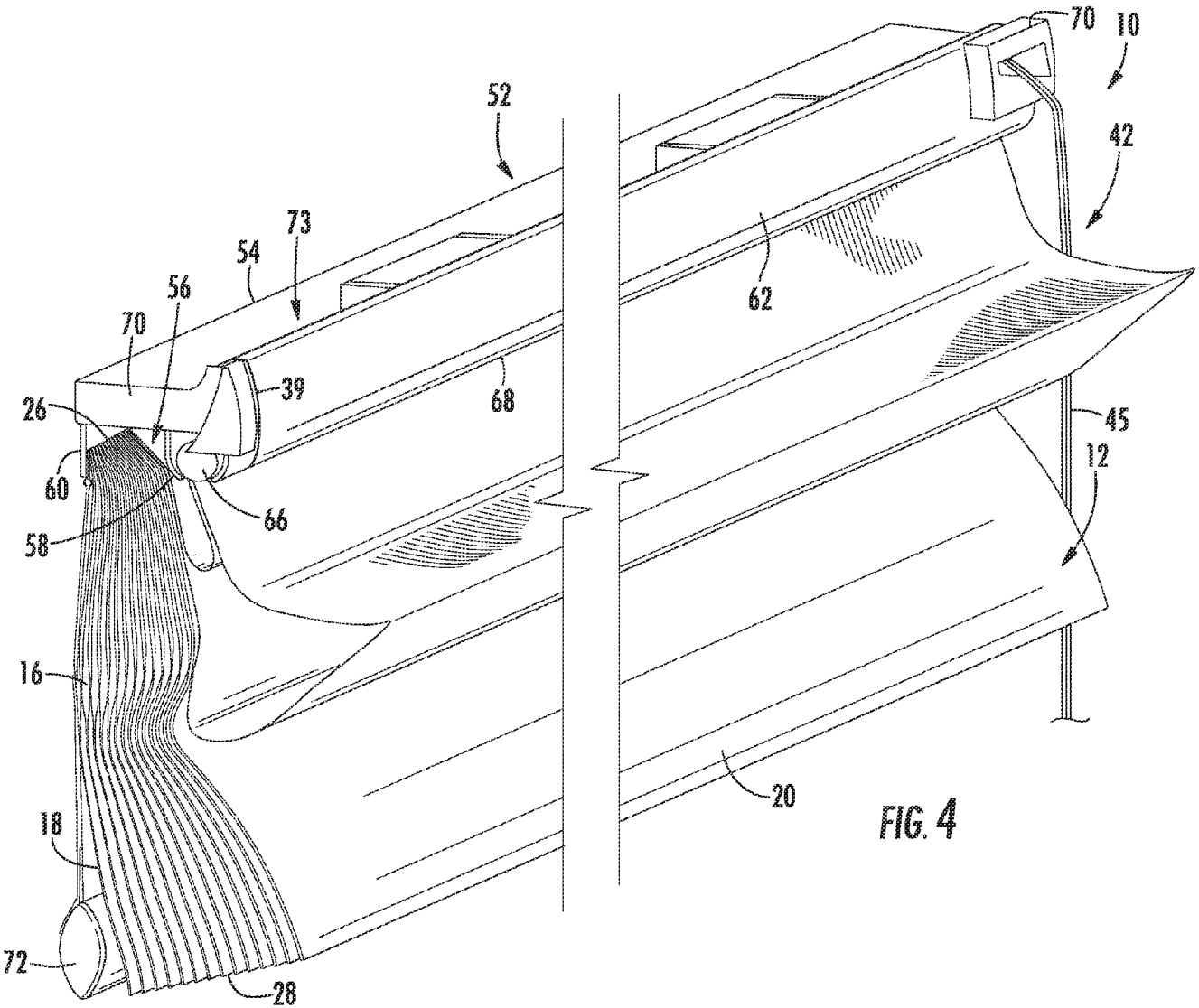
FIG. 4 is an enlarged perspective fragmented view of the shade assembly of FIG. 1 in a raised fully contracted configuration.

The shade assembly 10 includes a head rail 52 that is adapted to be mounted to the frame structure 74 of the window or other type of opening. The head rail 52 may include an extruded longitudinally extending component 54 that includes any number of chambers, channels, or other features necessary for incorporating a lift system, cords, pulleys, and the like, for raising and lowering the shade assembly 10 between a fully expanded configuration as illustrated in FIG. 1, and a fully contracted configuration as illustrated in FIGS. 3 and 4. The head rail 52 will be explained in greater detail below.

Figure 5A:
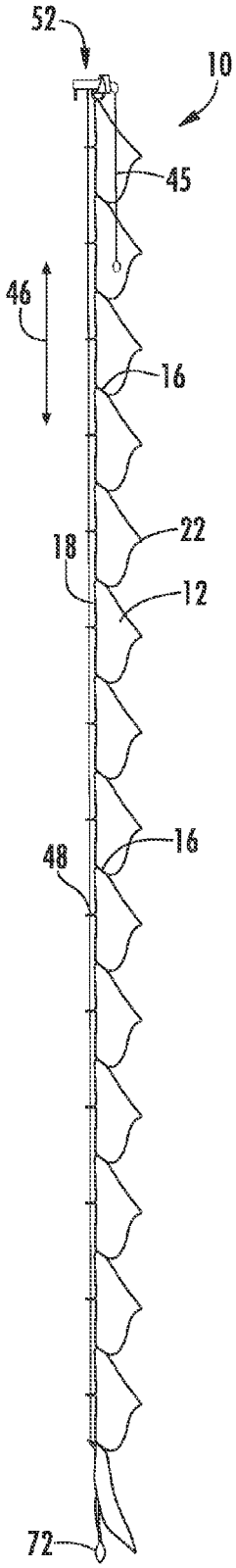
FIGS. 5A and 5B are side views of the shade assembly of FIG. 1 in a fully expanded configuration.
Figure 5B:
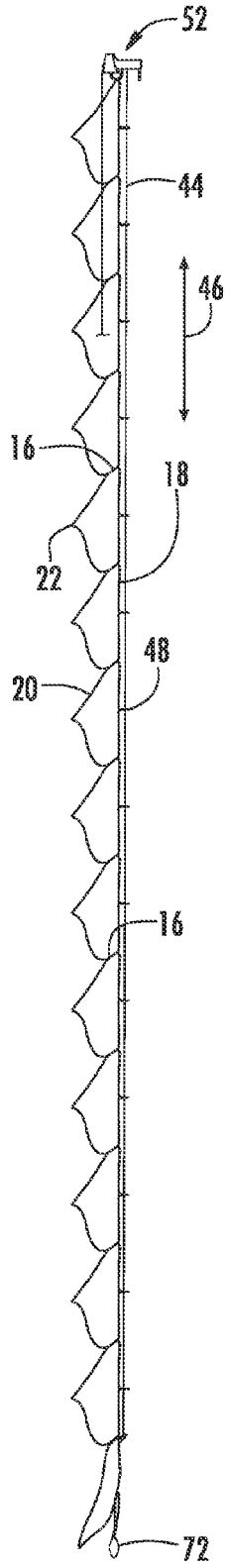

Referring to the various figures in general, each of the closed cell structures 12 has a back face 18 and a front face 20, which are separated by the juncture lines 16 between the adjacent cell structures 12. In other words, the juncture lines 16 divide the closed circumferential wall of each closed cell structure 12 into a front half (front face 20) and a back half (back face 18). In the fully expanded configuration of the shade assembly 10 illustrated in FIGS. 5*a* and 5*b*, the closed cell structures 12 have a cross-sectional profile such that the back face 18 has an essentially flat, vertical profile. The front face defined at the opposite side of the juncture lines 16 has a "soft" appearance in that it billows outwardly from the back face, and may have a drooping aspect as well.

The drooping and/or billowing profile provides a unique and aesthetically pleasing appearance, and may take on any manner of desired configuration. In the illustrated embodiments, the length of material between the juncture lines 16 defining the front face 20 of each of the closed cell structures is greater than the length of material between the juncture lines 16 defining the back face. In other embodiments, however, it should be understood that the front face may have substantially the same length as the back face. In this embodiment, the front face may have an essentially flat, vertical profile.

A crease 22 is formed in the front face of each of the closed cell structures 22 between the juncture lines 16. This crease 22 results in a unique three-dimensional expansion of the front face 20 wherein the portion of the front face from the upper juncture line 16 to the crease 22 is essentially flat, and the bottom portion of the front face 20 from the crease 22 to the lower juncture line 16 has an outwardly curved or billow shape, as particularly depicted in FIGS. 5A, 5B, and 6.

The creases 22 also define a fold point for the front faces 20 in the fully contracted configuration of the shade assembly 10. For example, referring to FIGS. 6 and 7, it is readily seen that the creases 22 in the individual closed cell structures 12 cause the cell structures 12 to close such that the front face 20 collapses against itself along the crease 22. Similarly, the back face 18 also collapses upon itself in the contracted configuration. Thus, each collapsed cell includes a downwardly extending section that comprises a folded front face and an upwardly extending section that comprises a folded back face. The creases 22 define bottom edges 28 of the collapsed cell structures 12 in the fully contracted configuration of the shade assembly 10, as illustrated in FIG. 7.

The shade assembly 10 includes a lift system 42 configured for vertically drawing the closed cell structures 12 from their fully expanded configuration into a fully contracted configuration. Various cord-type lift systems are well known in the art, and any one of these types of systems may be configured or utilized for use with the present shade assembly 10. In the particular embodiment illustrated throughout the figures, the lift system 42 includes a plurality of lift cords 44. Referring particularly to FIGS. 5A, 5B, 6, and 9, the lift cords 44 are disposed in a vertical line of action 46 that is rearward of (i.e. behind) the back faces 18 of the vertically aligned cell structures 12. The line of action 46 refers to the plane in which lift cords 44 move to draw the individual cell structures 12 up towards the head rail 52 into a fully contracted configuration, as illustrated in FIG. 7, as well as the plane in which the lift cords 44 move in order to deploy the cell structures 12 into a fully expanded configuration. It should be appreciated that in the particular illustrated embodiment, the lift cords 44 do not extend through the closed cell structures. In other words, the lift cords do not break or penetrate through the closed circumferential wall of the individual cell structures 12.

The lift cords 44 may vary in number depending on the width of the shade assembly 10. In the illustrated embodiments, for example, at least two lift cords 44 are illustrated. The lift cords 44 are attached or engaged with the back faces 18 of the cell structures 12 at an attachment location 48 that is between the juncture lines 16, generally at about the midpoint of each of the back faces 18. The attachment locations 48 define a fold line for the cell structures 12 in their collapsed state, as particularly illustrated at FIG. 6.

Figure 7:
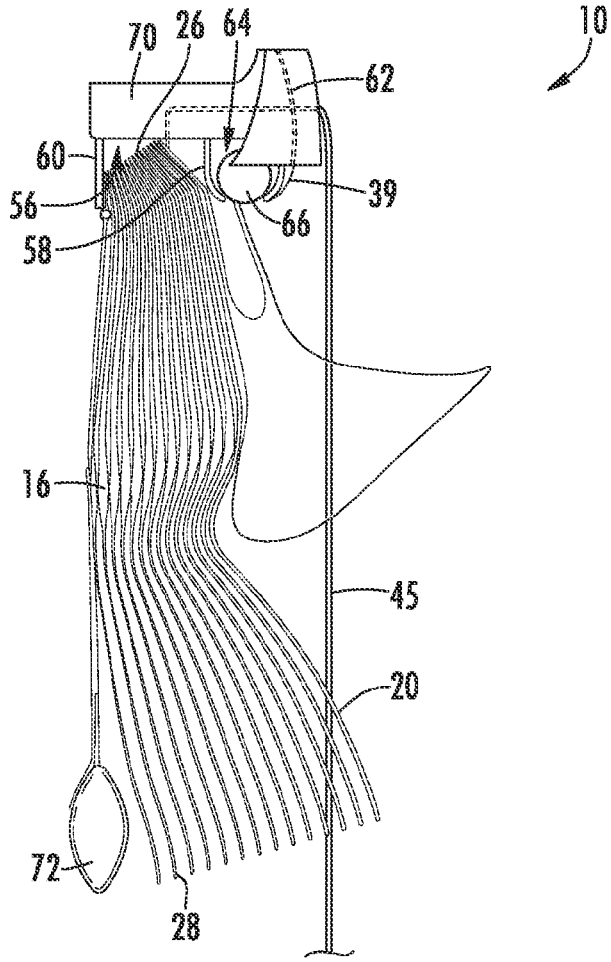
FIG. 7 is an enlarged left-hand side view of the shade assembly of FIG. 6 in a raised fully contracted configuration and illustrates the position of the lift cords in headrail in phantom.
Figure 11:
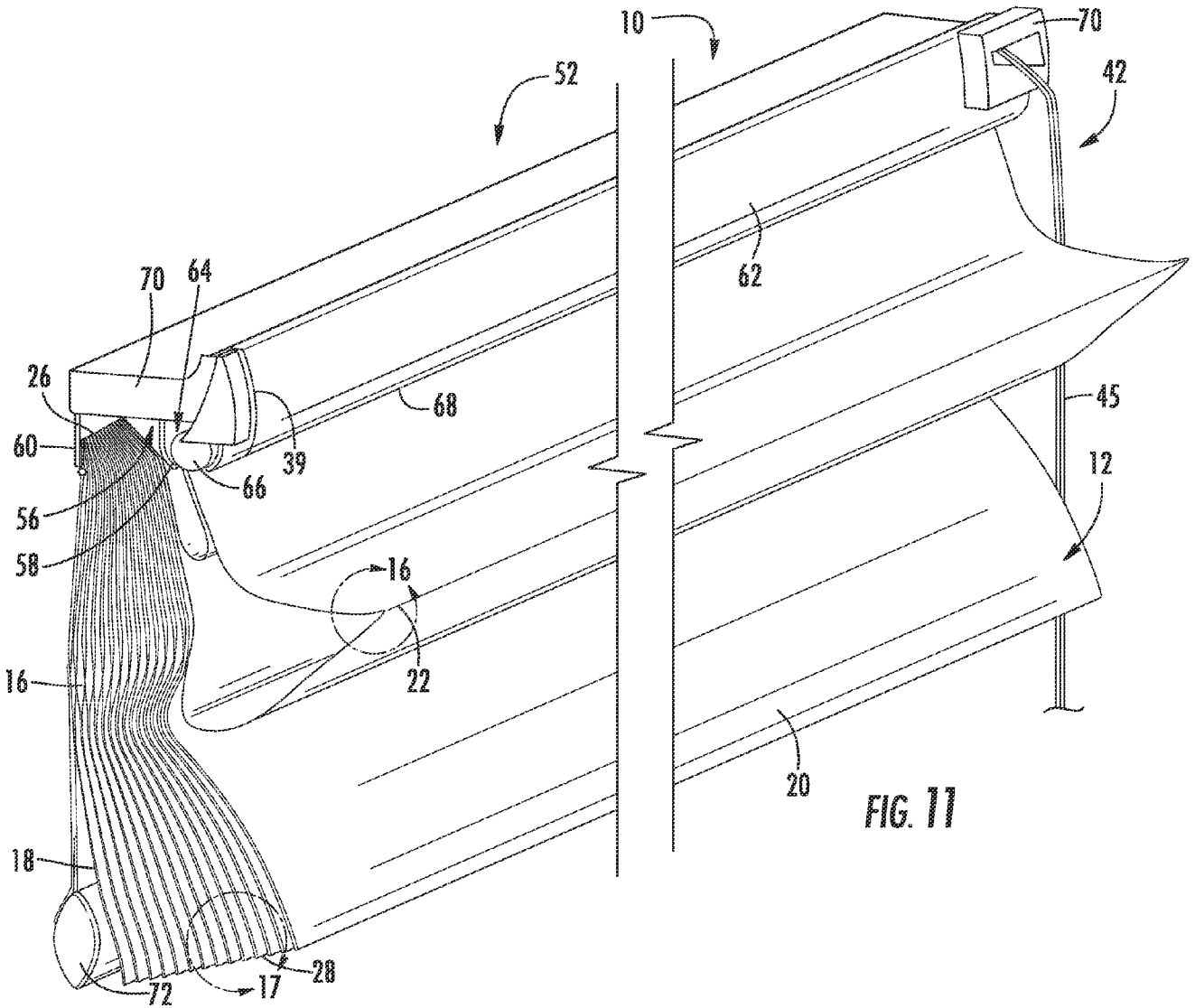
FIG. 11 is a view similar to FIG. 4 and particularly identifies the creased front faces of the cell structures as defining the bottom edges of the collapsed cell structures in the fully contracted configuration of the shade assembly.

As particularly illustrated in various ones of the figures, for example, FIGS. 4, 7, and 11, the plurality of closed cell structures 12 are drawn together and hang essentially vertically from the lift cords 44 in the contracted configuration of the shade assembly 10. The collapsed cell structures 12 have upper edges 26 that are generally defined by the attachment locations 48 with the lift cords 44. These upper edges 26 are adjacent and oriented in an upward vertical direction. Similarly, the bottom edges 28 defined by the creases 22 of the collapsed cell structures 12 are adjacent and oriented in a downward vertical direction. In this unique configuration, when viewed from the front of the shade assembly 10, the gathered and collapsed cell structures 12 appear to hang vertically from out of the head rail assembly 52 in a unique and aesthetically pleasing configuration. In addition, the depth of the vertically oriented and collapsed cell structures (measured perpendicular to the plane of the window frame 74) is significantly reduced as compared to conventional Roman shades and corresponds essentially to the thickness of the vertical stack of collapsed cell structures 12. Thus, the window or door frame structure 74 need not be enlarged to accommodate shades having larger, softer front panels.

Figure 6:
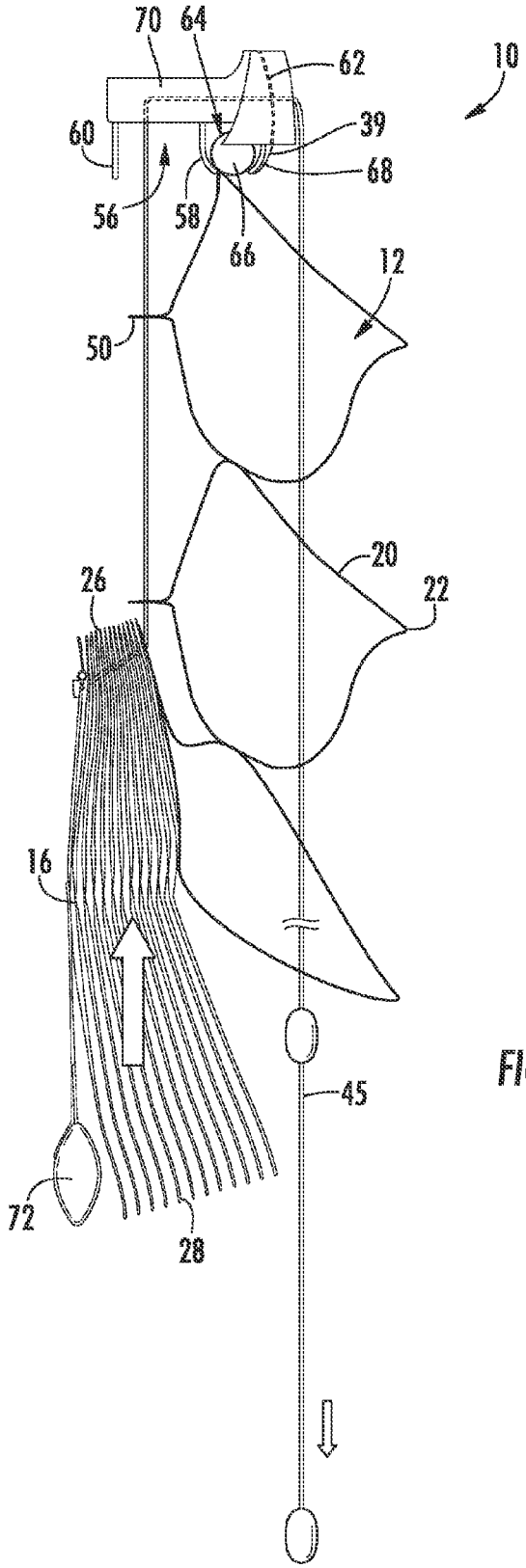
FIG. 6 is an enlarged side operational view of the shade assembly of FIG. 1 as it is being raised to a partially contracted configuration.
Figure 8:
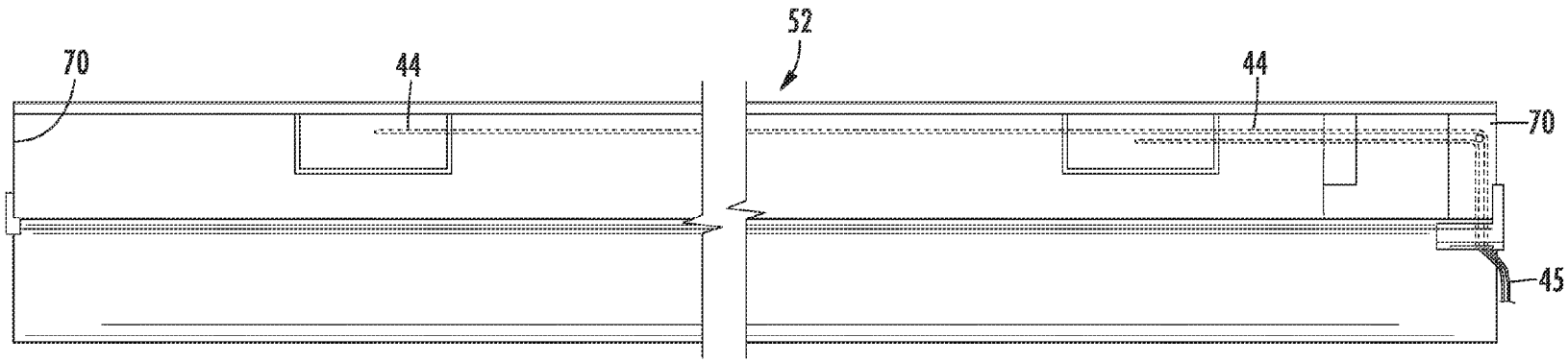
FIG. 8 is a perspective fragmented top view of the shade assembly of FIG. 7 particularly illustrating the headrail component.
Figure 9:
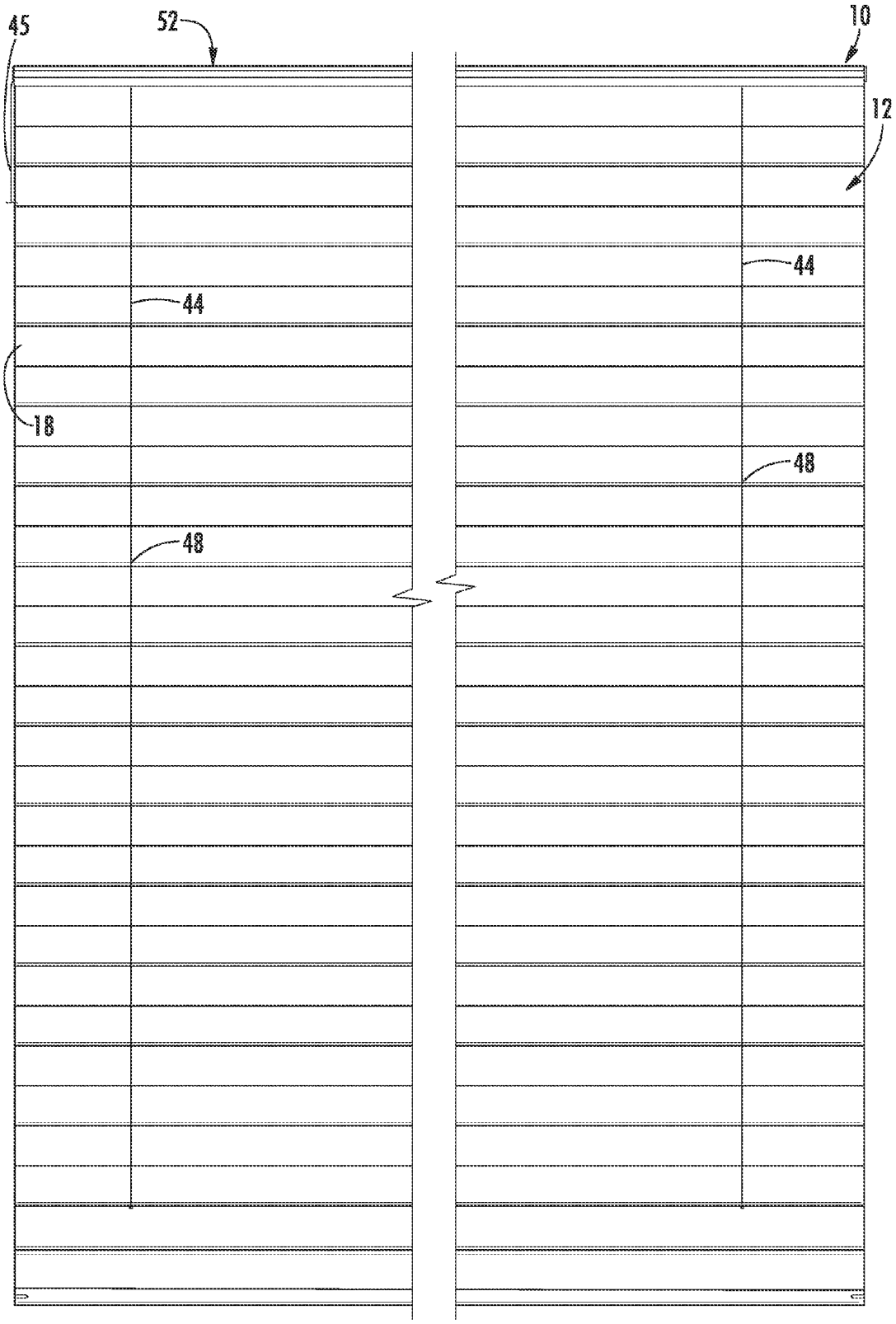
FIG. 9 is a back view of the shade assembly of FIG. 1 in a fully expanded configuration.

The lift cords 44 are actuated or operated by pull cords 45, illustrated for example in FIGS. 4, 6, and 7. The pull cords 45 may be extensions of the lift cords 44 and are presented at a front or side of the shade assembly 10 for a user's convenience in operating the shade assembly. The cords 45, 44 may be operationally disposed along the length of the head rail 52, as generally illustrated for example in FIGS. 8 and 10. It should be readily appreciated that any manner of pulley, bearing, guide, and the like, may be incorporated in the head rail 52 for this purpose.

The lift cords 44 may engage with the back faces 18 of the individual cell structures 12 by various means. In the embodiment illustrated in the figures, each cell 12 includes a tab 50 extending transversely from about the midpoint of the back face 18, with the lift cords 44 being engaged with the tabs. For example, the lift cords 44 may pass through a hole or grommet in each of the tabs 50. The tabs 50 may be a member that is separately formed and attached to the back face 18 of the cell structures 12, or may be formed by a folded or pleated section of the back face 18, as particularly illustrated in the figures, particularly FIG. 23.

FIGS. 4, 6, 7, and 11 illustrate a unique configuration of the head rail assembly 52 wherein the extruded component 54 defines a longitudinally extending tray 73 in which the cords 44, 45 are disposed, as well as any other necessary component of a lifting or control system. The extruded component 54 further defines a longitudinally extending internal channel 56 that is defined between a back guide member 60 and a front guide member 58. This internal channel 56 defines a space in which the upper edges 26 of the collapsed cell structures 12 are drawn and held in an adjacent and vertically oriented configuration in the fully contracted state of the shade assembly 10, as illustrated in FIGS. 4 and 7. It should be appreciated that the internal channel 56 may be defined by any manner of structure that is formed integrally with the extruded component 54, or added to the extruded component 54.

Still referring to the head rail assembly 52 in general, a separate retaining channel 64 may also be defined in the head rail. In the illustrated embodiment, this retaining channel 64 is defined between the front guide member 58 and a front panel 62. The front panel 62 may also define the front face of the head rail 52 that is visible from the front of the shade assembly 10 and, in this regard, may have any desired length or aesthetically pleasing configuration. The front panel 52 may include a curved bottom lip 68 that is oriented towards a curved lip of the front guide member 58, as particularly illustrated in the figures. A retaining bar, rod, or other member 66 is disposed longitudinally within the retaining channel 64 and serves as the anchor attachment location of the cell structures 12 to the head rail 52. Referring for example to FIG. 6, the uppermost cell structure 12 includes an extension segment 39 that is adhered or otherwise attached to the retaining bar 66. Thus, in construction of the shade assembly 10, it is only necessary to attach the uppermost cell structure 12 to the retaining bar 12 and to then slide the retaining bar into the channel 64 from an end of the head rail 52. In a particularly unique embodiment illustrated in the figures, the material that defines the front face 20 of the uppermost cell structure 12 also defines the head rail extension segment 39. This material may also wrap around the bar 66 and extend onto the front face of the panel 62, as particularly illustrated in FIGS. 4, 6, and 11. In this manner, the material that defines the cell structures 20 may also act as a decorative covering to the front panel 62, thus eliminating the requirement for a separate valence or similar device.

The head rail 52 includes an end cap 70 at each of the longitudinal ends of the extruded member 54. The end caps 70 may serve functional and decorative purposes, and generally serve to hold and maintain various functional elements of the shade assembly 10 in an operational configuration.

Figure 10:
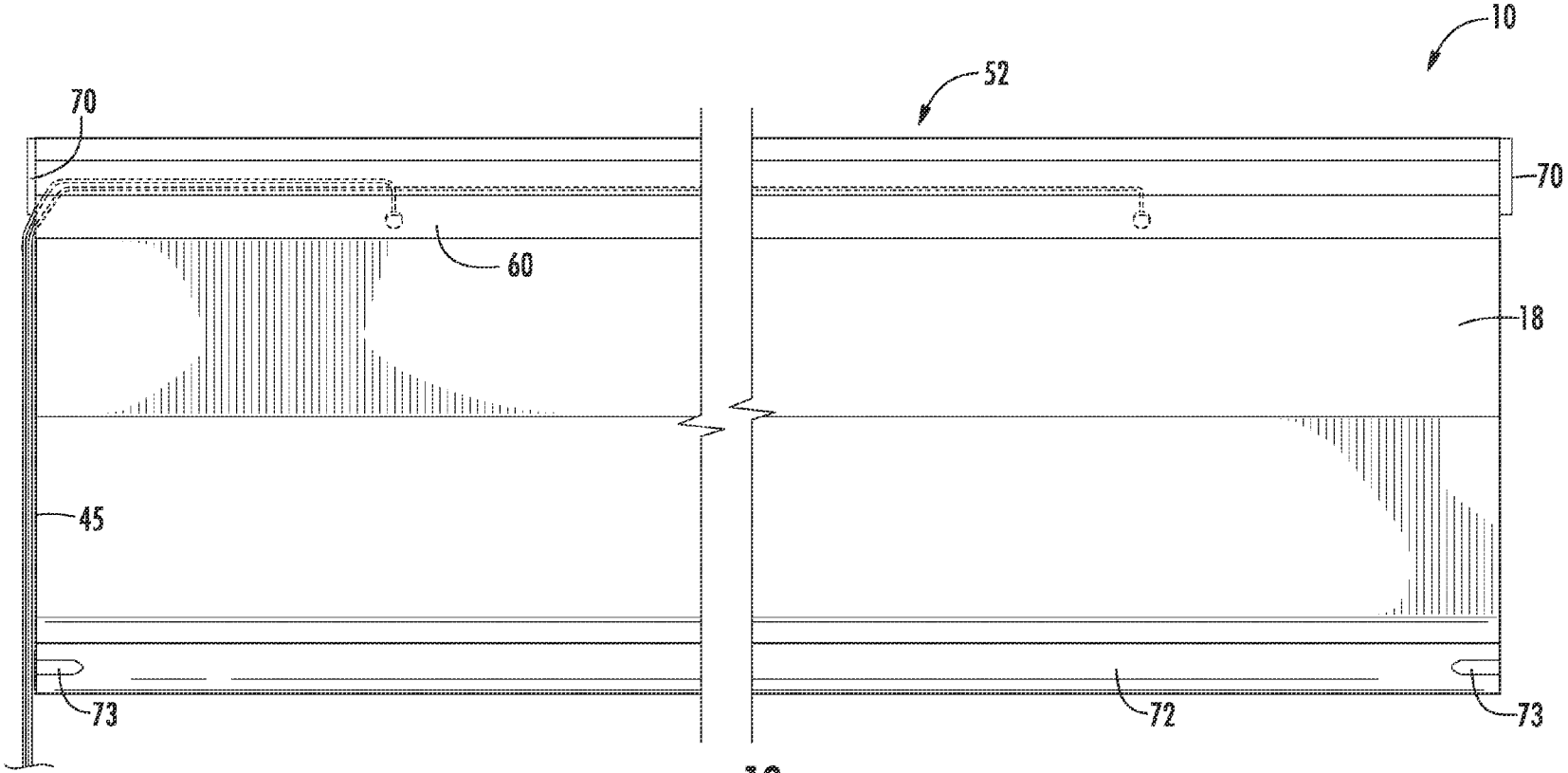
FIG. 10 is an enlarged fragmented back view of the embodiment of FIG. 9 in a fully contracted configuration and illustrates components of the headrail lift assembly in phantom.

To aid in raising and lowering the shade assembly 10, it may be desired to include a ballast member 72 with the bottommost cell structure 12. In the illustrated embodiment, the ballast member 72 is a bar or other weighted member that extends generally from the back face 18 of the bottommost cell structure 12, as particularly illustrated in FIGS. 5A, 5B, and 6. A piece of material that may be separate from the back face 18, or an extension of the back face 18, may be used to attach the ballast 72 to the cell structure 12. Referring to FIG. 10, this piece of material may be folded around and clipped to the ballast 72 by a conventional clip 73. Alternatively, the material may be adhered or otherwise attached to the ballast member 72.

Figure 21:
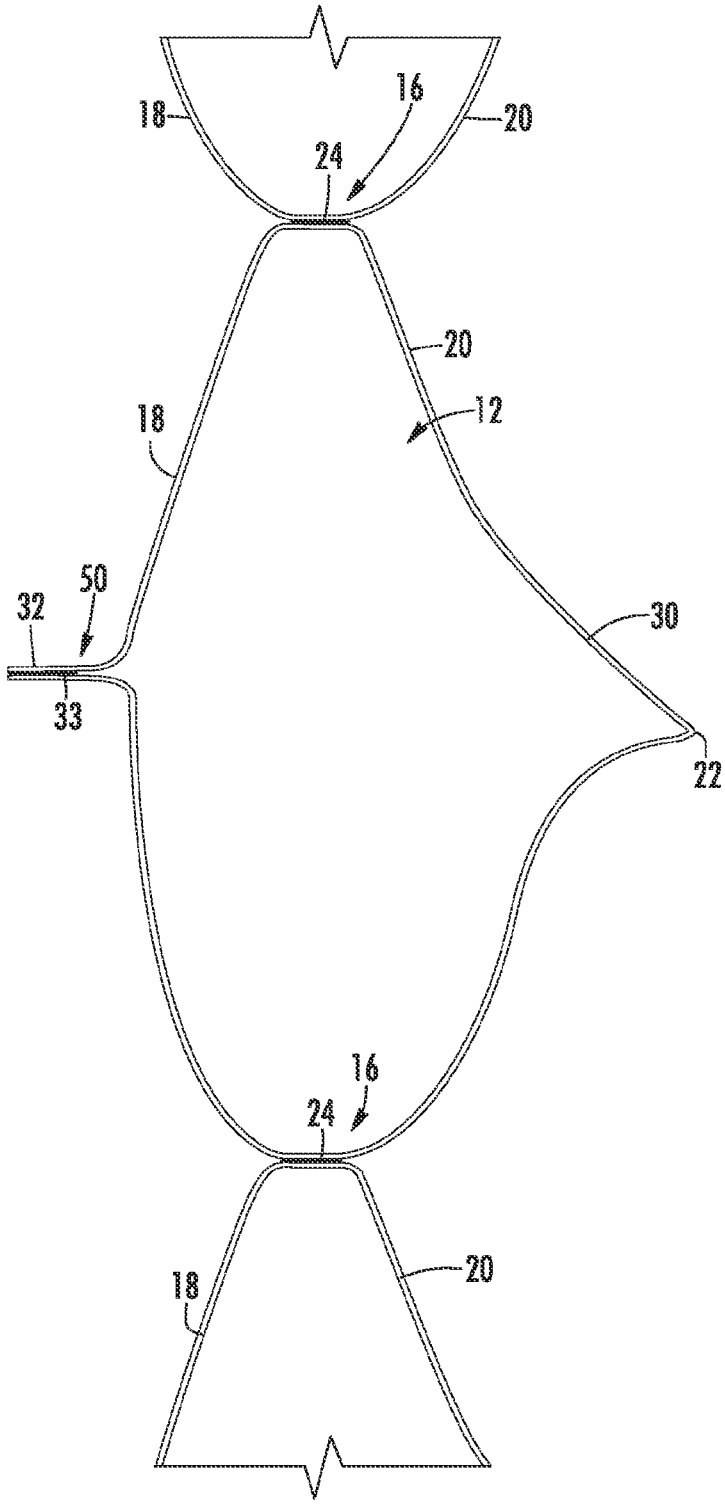
FIG. 21 is an enlarged side view of an embodiment of a closed cell structure in accordance with aspects of the invention.
Figure 22:
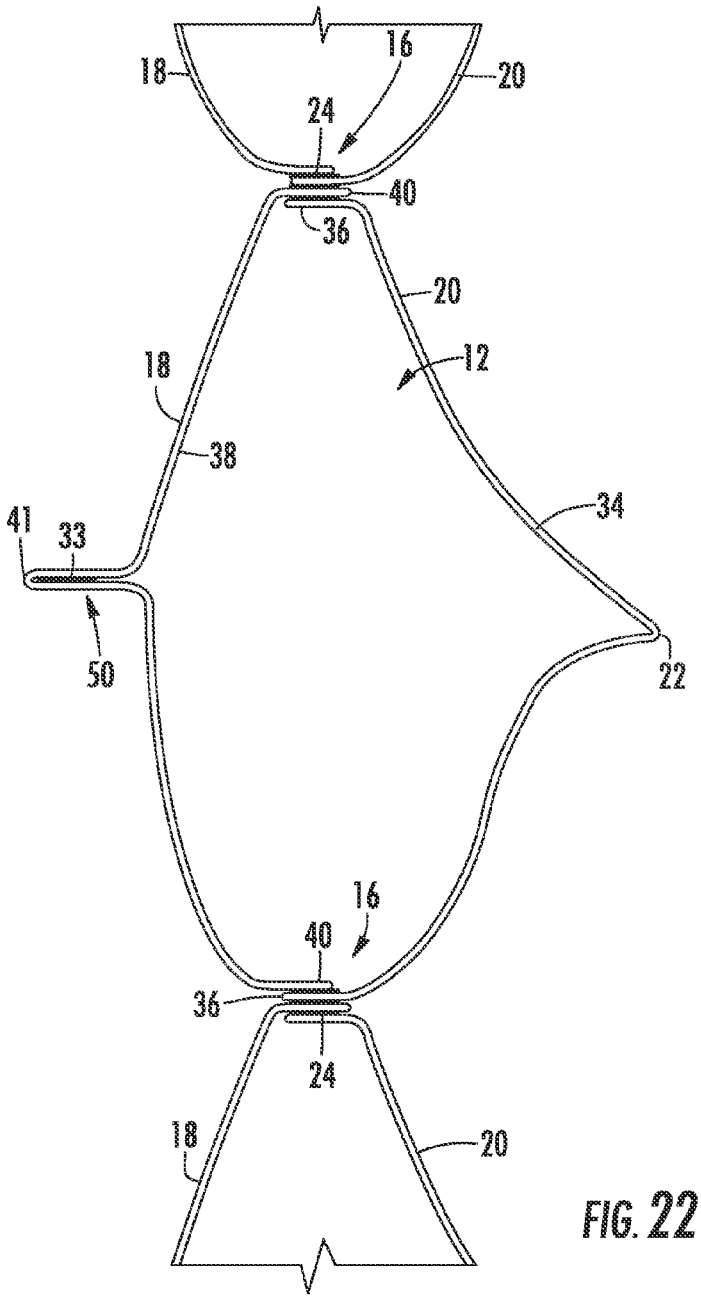
FIG. 22 is an enlarged side view of an alternative embodiment of a closed cell structure in accordance with aspects of the invention.
Figure 23:
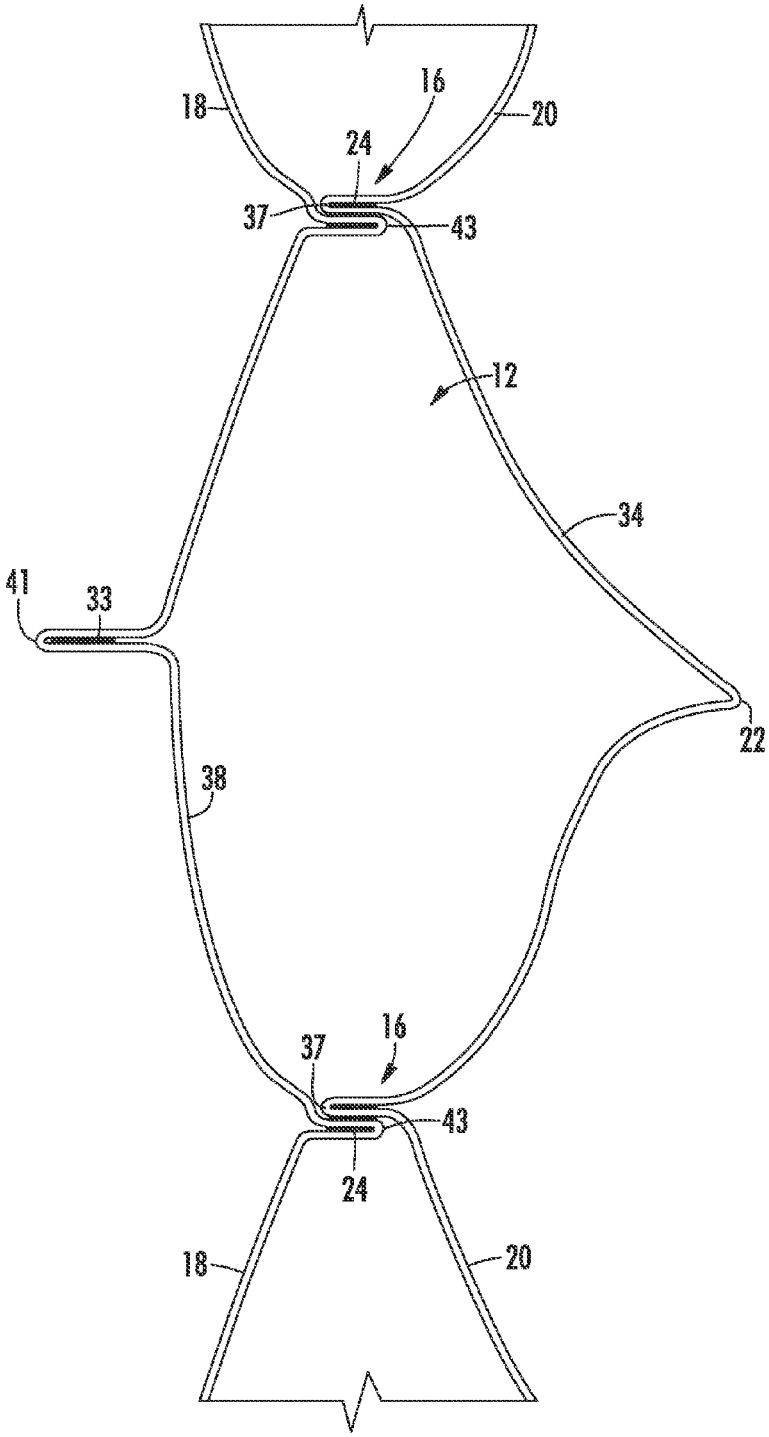
FIG. 23 is an enlarged side view of yet another alternative embodiment of a closed cell structure in accordance with aspects of the invention.

FIGS. 21 through 23 illustrate various configurations of the cell structures 12. In the embodiment of FIG. 21, each individual cell structure 12 is formed from a single material piece 30. The material piece 30 has edges 32 that are joined with any conventional attachment means 33, such as adhesive, sonic weld, and the like. The attachment location of the edges 32 defines the tab 50 at the back face 18 of each cell structure 12. The individual cell structures 12 are joined to adjacent cell structures at juncture lines 16 by any manner of conventional attachment mechanism 24, such as an adhesive, sonic weld, stitching, or the like.

In the embodiment of FIG. 22, each individual cell structure 12 is defined by a first material piece 34 having edges 36, and a second material piece 38 having edges 40. The first material piece 34 defines the front face 20 of the cell structure 12 and includes the crease 22 formed therein. The second material piece 38 defines the back face 18 of the cell structure 12 and includes a folded portion 41 that is tacked with an adhesive, weld, or other attachment 33 to define the tab 50. At the juncture lines 16, the edges 36 of the first material piece 34 are attached to the edges 40 of the second material piece 38. The edges 40, 36 of the adjacent cell structures 12 are also attached to each other and to the adjacent cell structures at the juncture lines 16, as particularly illustrated in FIG. 22.

In the embodiment of FIG. 23, the front face 20 of adjacent cell structures 12 are formed from a continuous piece of material 34 that is folded at folds 37 and tacked by an adhesive, weld, or other mechanism 24 at the juncture lines 16. Similarly, the back faces 18 of adjacent cells 12 are formed by a continuous second material piece 38 that is also folded at folds 43 and tacked at the juncture lines 16. The folds 37 and 43 are attached to each other at the juncture lines 16, as particularly illustrated in FIG. 23. Thus, with this embodiment, the first and second material pieces 34, 38 may be common to a plurality of the closed cell structures 12 such that a single material piece defines the front faces for multiple ones or all of the cells 12, and a second material piece may define the back faces for multiple ones of or all of the cells 12.

Figure 24:
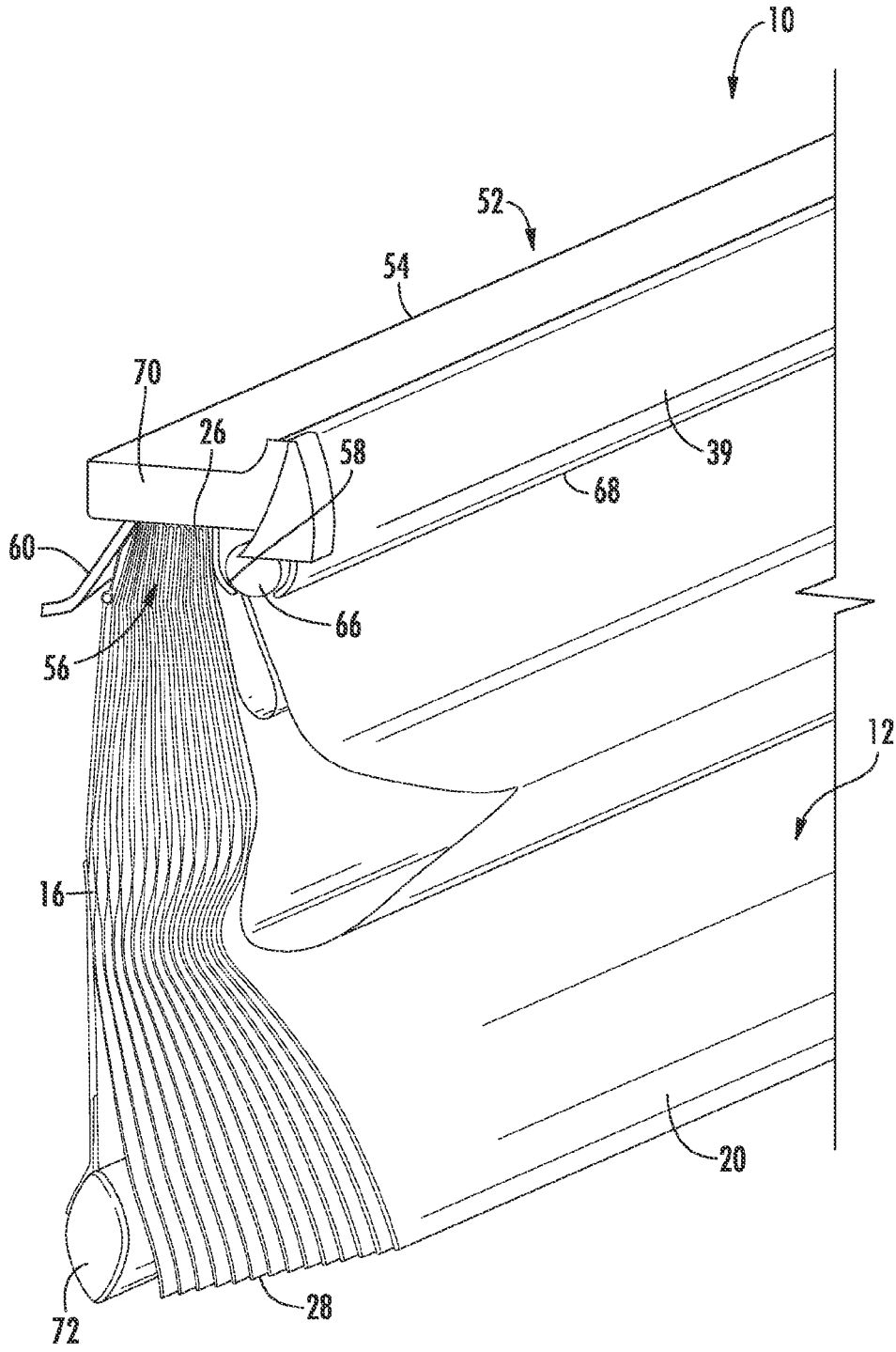
FIG. 24 is a perspective view of an alternative embodiment of a shade assembly in accordance with aspects of the invention.
Figure 25:
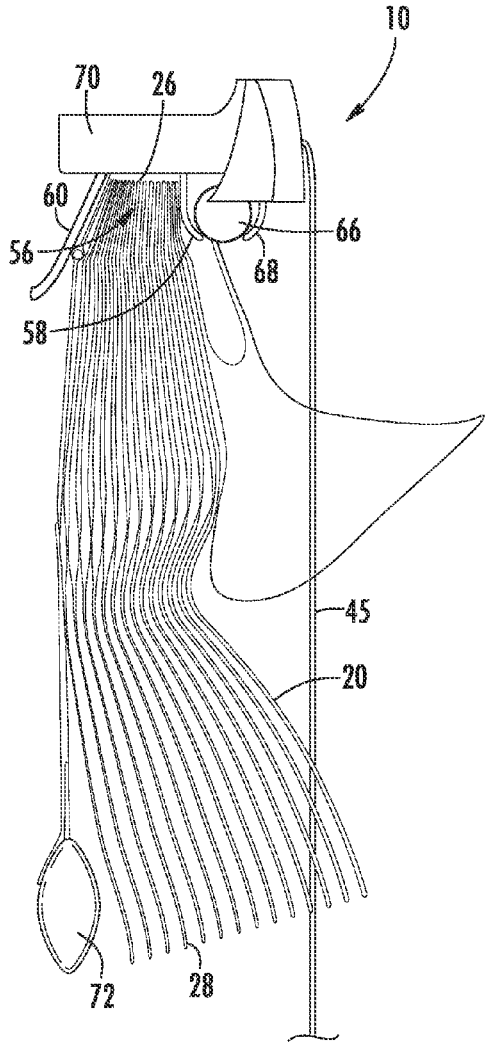
FIG. 25 is a side view of the shade assembly of FIG. 24.

FIGS. 24 and 25 illustrate an alternative unique configuration of the head rail 52. In this embodiment, the internal channel 56 has a tapering cross-sectional profile that narrows from an open end towards the extruded component 54. This taper may be defined by one or both of the guide members 60, 58. In the illustrated embodiment, the taper is provided primarily by the back guide member 60 that is angled towards the front guide member 58. The tapered channel 56 has an initial width at the open end thereof to ensure that all of the gathered top edges 26 of the collapsed cell structures 12 are easily drawn into the channel 56. The taper then serves to ensure that the top edges 26 are maintained at an essentially vertical orientation as they are drawn further into the channel 56 by the lift cords 44. At its closed end, the channel 56 has a width that is at least slightly greater than the thickness of the stack of vertically oriented edges 26 so that the edges 26 are not compressed and wedged into the channel 26, which could cause a problem in subsequent deployment of the cells 12 to the fully expanded configuration. It should be appreciated that the unique embodiment of FIGS. 24 and 25 serves to further vertically orient the collapsed stack of cell structures 12, as compared to the embodiment of FIGS. 6 and 7. This may be a desired characteristic depending on the type of material used to form the cell structures, dimensions of the window or opening frame 74, and desired appearance of the shade assembly 10 in the fully contracted configuration.

Figure 12:
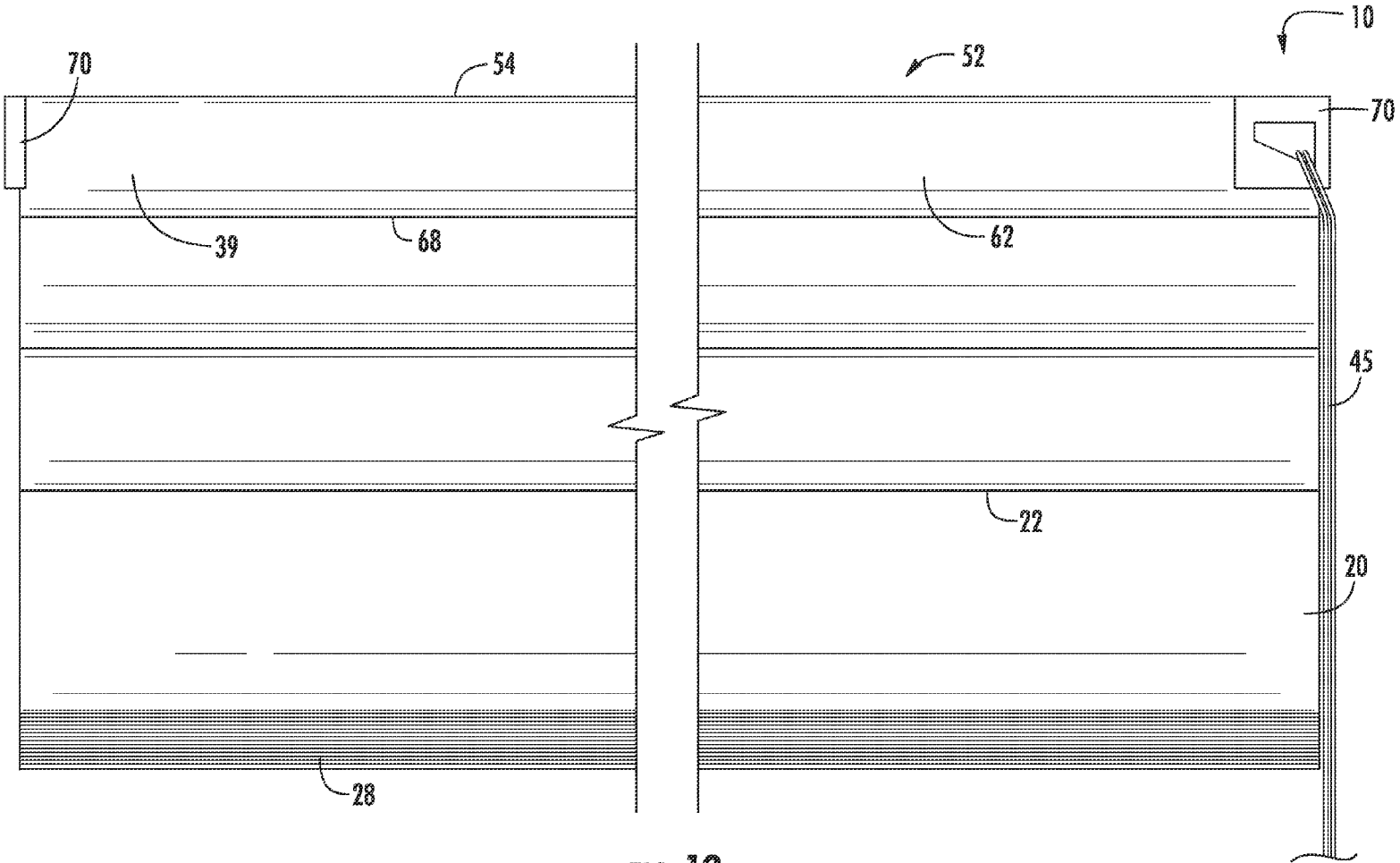
FIG. 12 is a fragmented front view of the shade assembly of FIG. 1 in a partially contracted configuration.

Various other ones of the figures not described in detail herein illustrate various views and aspects of the elements described above. For example, FIG. 12 is a fragmented front view of the shade assembly of FIG. 1 in a partially contracted configuration, and particularly illustrates the pull cords 45 directed out of the right-hand end cap 70, as well as the position and aspect of the front panel 62 with the material piece extension 39 thereon to provide a uniform appearance from the front side of the shade assembly 10.

Figure 13:
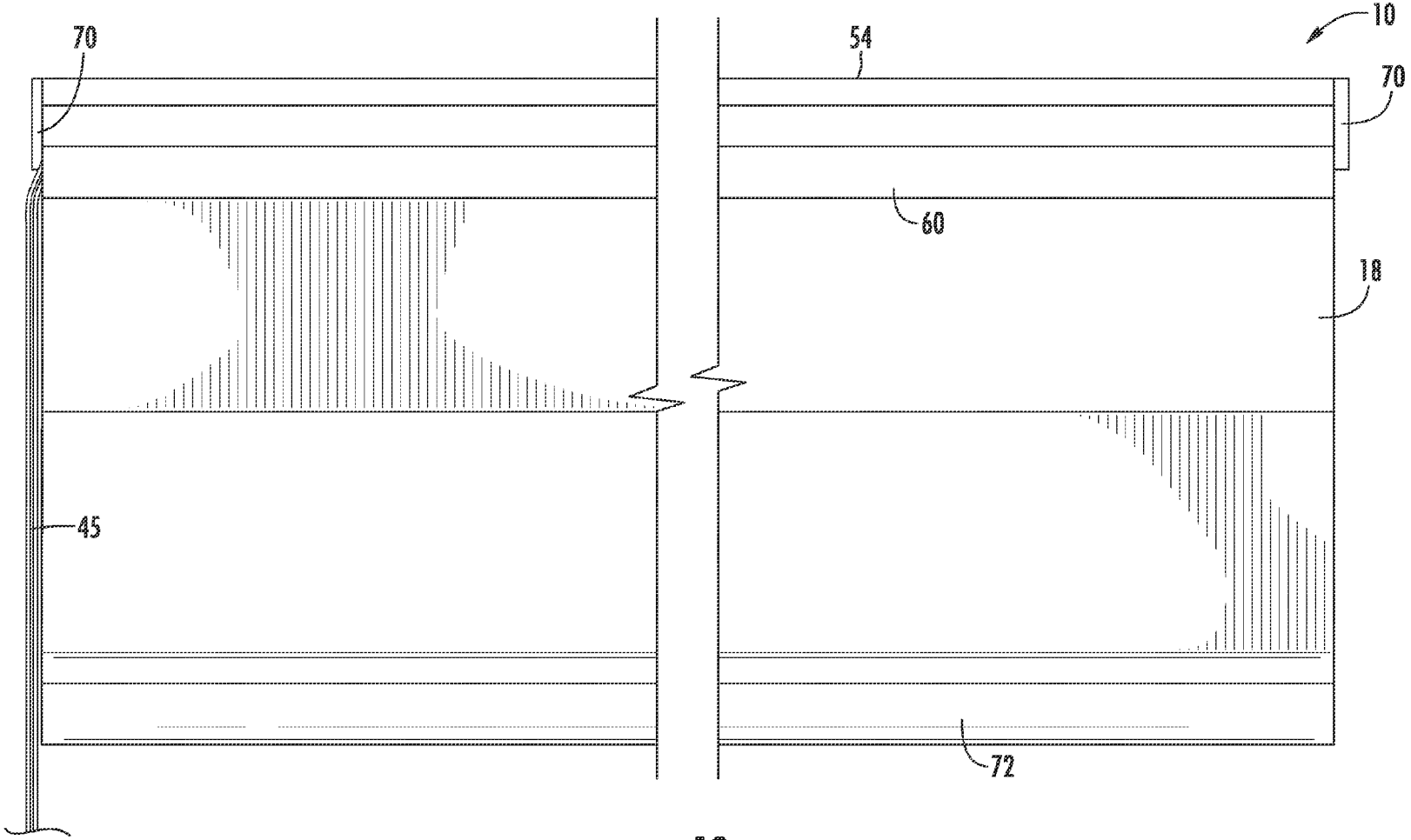
FIG. 13 is an enlarged fragmented back view of the embodiment of FIG. 1 in a fully contracted configuration.

FIG. 13 is an enlarged fragmented view of the embodiment of FIG. 1 in a fully contracted configuration.

Figure 14:
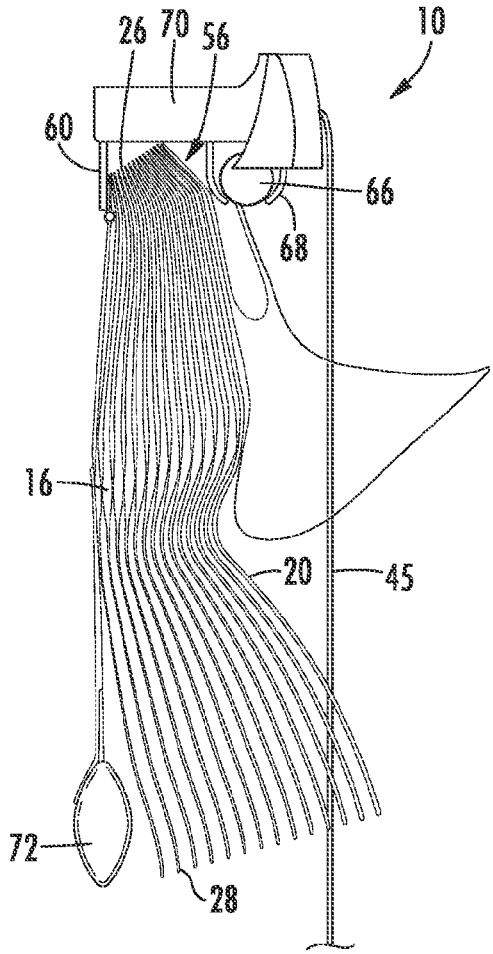
FIG. 14 is an enlarged left-hand side view of the shade assembly of FIG. 1 in a raised fully contracted configuration.
Figure 15:
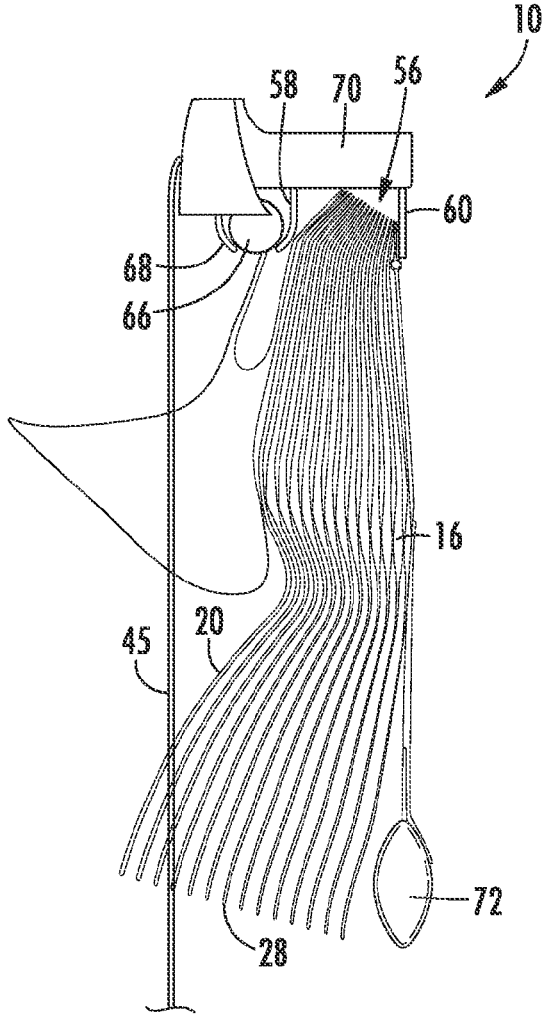
FIG. 15 is an enlarged right-hand side view of the shade assembly of FIG. 1 in a raised fully contracted configuration.

FIGS. 14 and 15 are left-hand and right-hand side views, respectively, of the shade assembly of FIG. 1 in a raised fully contracted configuration.

Figure 16:
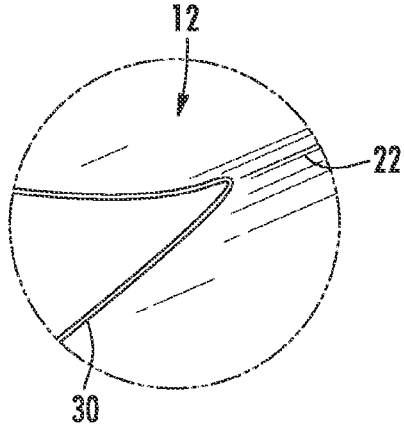
FIG. 16 is an enlarged perspective view of the section indicated in FIG. 11.
Figure 17:
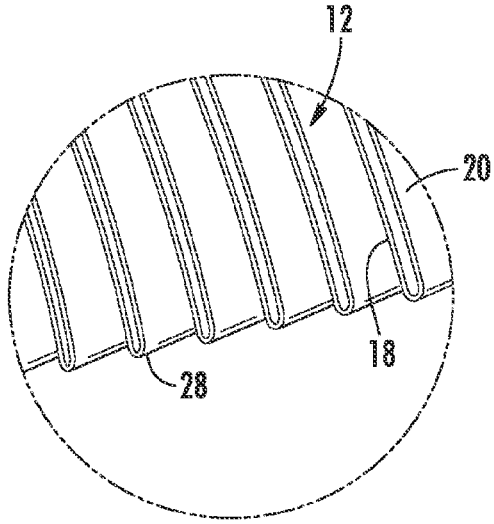
FIG. 17 is an enlarged perspective view of the section indicated in FIG. 11.

FIGS. 16 and 17 are enlarged perspective views particularly illustrating the crease 22 formed in the front faces of the individual cell structures 12, and which also define the bottom edges 28 of the collapsed cell structures 12 (FIG. 17).

Figure 18:
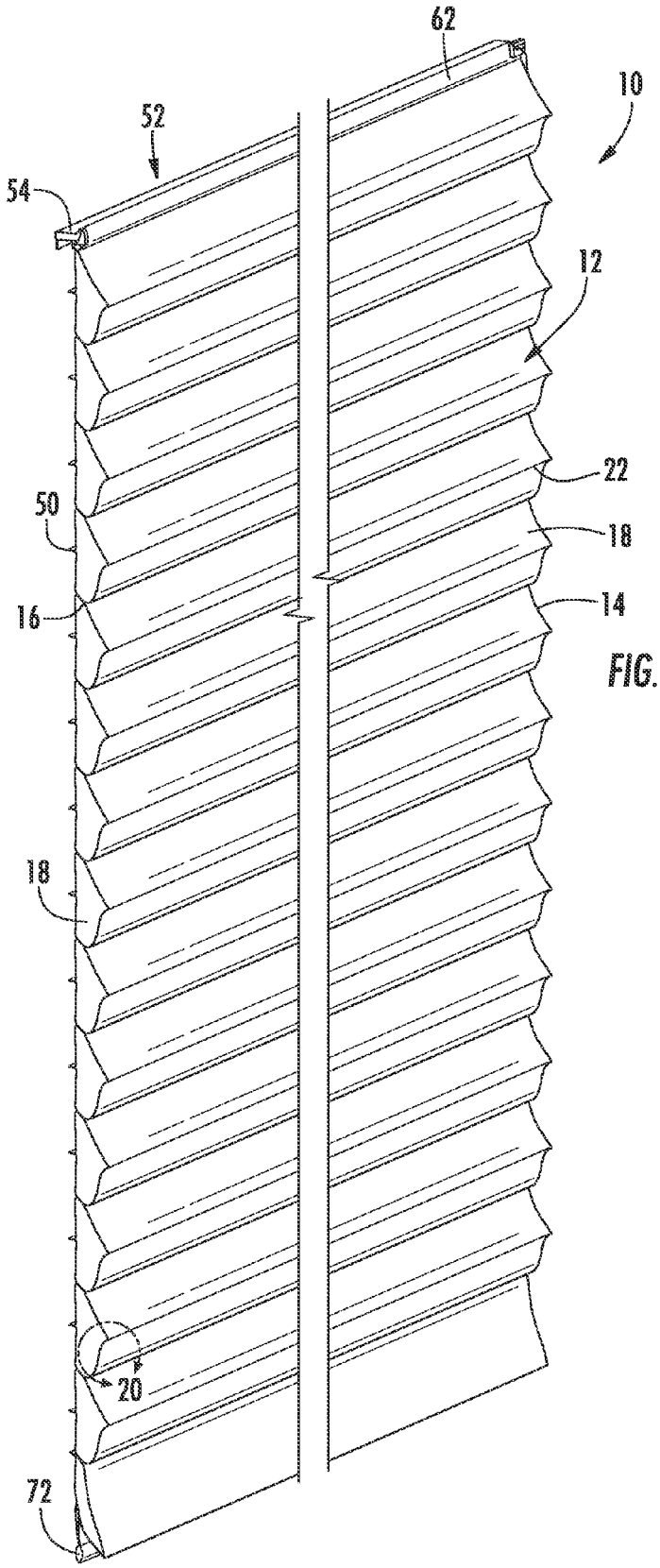
FIG. 18 is a perspective fragmented view of the shade assembly of FIG. 1 in a fully expanded configuration.

FIG. 18 is a perspective view of the shade assembly similar to FIG. 1 removed from a frame or other opening structure.

Figure 19:
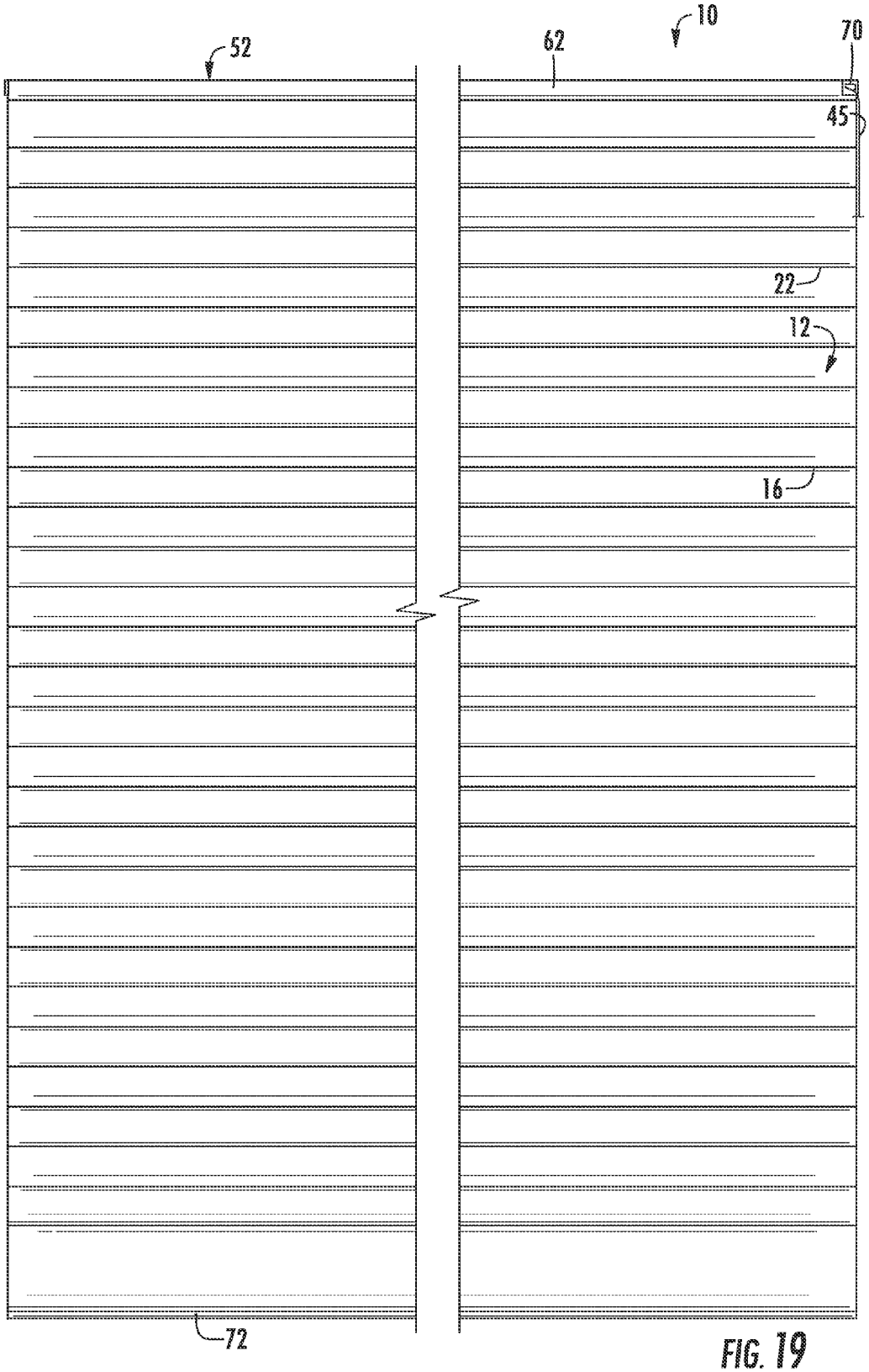
FIG. 19 is a fragmented front view of the shade assembly of FIG. 1 in a fully expanded configuration.

FIG. 19 presents a front view of the shade assembly 10, and particularly illustrates the unique aesthetically pleasing front view of the shade.

Figure 20:
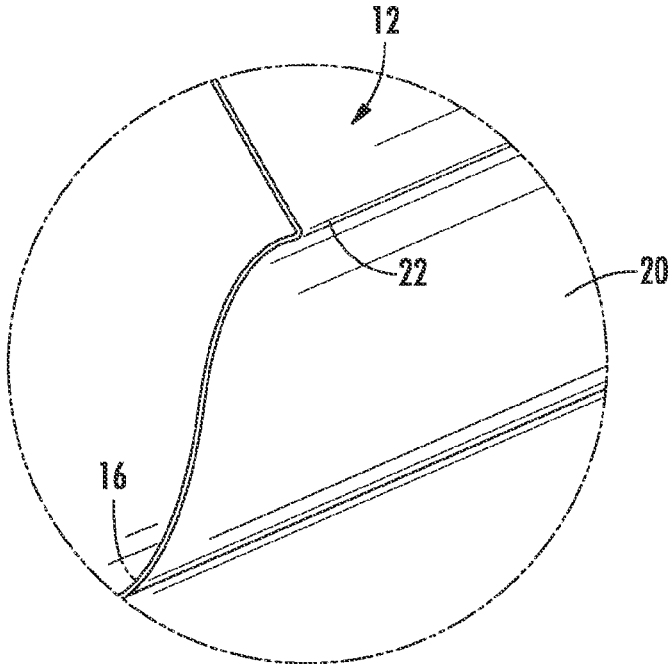
FIG. 20 is an enlarged perspective view of the section indicated in FIG. 18.

FIG. 20 is an enlarged view of a portion of the front face 20 of a closed cell structure 12, and particularly illustrates the relationship between the juncture line 16 and the billowed or expanded portion of the front face, which may result in the juncture line 16 not being visible from the front side of the shade assembly.

It should be readily appreciated by those skilled in the art that various modifications and variations can be made to the embodiments of the shade assembly 10 described herein without departing from the scope and spirit of the invention.

What is claimed is:

1. An expandable and contractable shade assembly, comprising:

a plurality of closed cell structures disposed longitudinally along a width dimension of said shade assembly, said closed cell structures aligned vertically one above another with juncture lines defined between adjacent ones of said vertically aligned closed cell structures;

at a fully expanded configuration of said shade assembly, said closed cell structures having a cross-sectional profile such that a back face of said closed cell structures defined between said juncture lines has an essentially flat vertical profile opposite a front face of said closed cell structures;

a lift system configured for vertically drawing said closed cell structures from said fully expanded configuration into a fully contracted configuration, said lift system comprising a plurality of lift cords that lie along a vertical line of action rearward of said back face of said closed cell structures;

said lift cords engaged with said back face of each said closed cell structure only at an attachment location at about a mid-point of said back face between said juncture lines; and wherein in said fully contracted configuration of said shade assembly, each of said closed cell structures collapse into a flat profile, and said attachment locations with the lift cords causing each of the plurality of closed cell structures to hang from said lift cords in a vertical and adjacently disposed orientation thereby defining upper edges of each of said collapsed closed cell structures which are adjacent and oriented in an upward vertical direction and bottom edges of each of said collapsed closed cell structures which are adjacent and oriented in a downward vertical direction; and further comprising a headrail, said headrail comprising an internal channel into which said upper edges of each of said collapsed closed cell structures are drawn and maintained in their adjacent and vertically oriented configuration in said fully contracted configuration of said shade assembly.

2. The shade assembly as in claim 1, wherein said collapsed closed cell structures fold at a crease in said front face that defines said bottom edges, said crease defined at about a mid-point of said front face between said juncture lines.

3. The shade assembly as in claim 2, wherein said front face of said closed cell structures comprises a greater material length between said juncture lines than said back face, whereby in said expanded configuration of said shade assembly said front face droops below said juncture line of said closed cell structure with an immediately adjacent closed cell structure.

4. The shade assembly as in claim 1, further comprising a tab extending transversely from about at a mid-point of said back face of said closed cell structures at said attachment location of said lift cords, said lift cords engaging said tabs.

5. The shade assembly as in claim 4, wherein the tabs define holes through which the lift cords pass.

6. The shade assembly as in claim 4, wherein the tabs include an engagement device that engages the lift cords, the engagement device comprising a hook, a ring, or a loop.

7. The shade assembly as in claim 1, wherein the back faces include a crease that is located at about the mid-point of said back face between said juncture lines, the back faces further including holes positioned adjacent the creases through which the lift cords pass.

8. The shade assembly as in claim 1, wherein the back faces include a crease that is located at about the mid-point of said back face between said juncture lines, the back faces further including an engagement device located near the creases for engaging the lift cords, the engagement devices comprising hooks, rings or loops.

9. The shade assembly as in claim 4, wherein each said closed cell structure is formed by a single piece of flexible material joined at edges to define a closed cell, said joined edges defining said tab.

10. The shade assembly as in claim 1, wherein said front face of said closed cell structures is formed from a first material piece, and said back face of said closed cell structures is formed from a separate second material piece.

11. The shade assembly as in claim 10, wherein said first material piece and said second material piece are joined at said juncture lines to define a closed cell.

12. The shade assembly as in claim 10, wherein said first material piece is common to a plurality of said closed cell structures such that a single material piece defines said front faces for multiple closed cell structures.

13. The shade assembly as in claim 12, wherein said second material piece is common to a plurality of said closed cell structures such that a single material piece defines said back faces for multiple closed cell structures.

14. The shade assembly as in claim 1, wherein the front face of the closed cell structures is formed from a single material piece and the back face of the closed cell structures is formed from two separate material pieces.

15. The shade assembly as in claim 1, wherein said internal channel comprises a cross-sectional profile that tapers from an open end of said internal channel to a closed end of said internal channel.

16. The shade assembly as in claim 15, wherein said internal channel is defined by front and back guide members, said back guide member angled towards said front guide member to define said tapered cross-sectional profile.

17. The shade assembly as in claim 16, wherein said internal channel has a width at said closed end that is at least as great as a thickness of said upper edges of said adjacent and vertically oriented collapsed closed cell structures.

18. The shade assembly as in claim 1, wherein the front face of the closed cell structures is longer than the back face of the closed cell structures causing the front face to have an outwardly billowing profile.

19. An expandable and contractable shade assembly, comprising:

a plurality of closed cell structures disposed longitudinally along a width dimension of said shade assembly, said closed cell structures aligned vertically one above another with juncture lines defined between adjacent ones of said vertically aligned closed cell structures;

at a fully expanded configuration of said shade assembly, said closed cell structures having a cross-sectional profile such that a back face of said closed cell structures defined between said juncture lines has an essentially flat vertical profile, and a front face of said closed cell structures defined at an opposite side of said juncture lines;

a lift system configured for vertically drawing said closed cell structures from said fully expanded configuration into a fully contracted configuration, said lift system comprising a plurality of lift cords that lie along a vertical line of action rearward of said back face of said closed cell structures;

said lift cords engaged with said back face of each said closed cell structure only at an attachment location at about a mid-point of en said back face between said juncture lines;

wherein in said fully contracted configuration of said shade assembly, each of said closed cell structures collapse into a flat profile, and said attachment locations with the lift cords causing each of the plurality of closed cell structures to hang from said lift cords in a vertical and adjacently disposed orientation thereby defining upper edges of each of said collapsed closed cell structures which are adjacent and oriented in an upward vertical direction and bottom edges of each of said collapsed closed cell structures which are adjacent and oriented in a downward vertical direction;

a head rail comprising a tapered internal channel into which said upper edges of each of said collapsed closed cell structures are drawn and maintained in their adjacent and vertically oriented configuration in said fully contracted configuration of said shade assembly.

20. The shade assembly as in claim 19, wherein said internal channel has a width at a closed end thereof that is at least as great as a thickness of said upper edges of said adjacent and vertically oriented collapsed closed cell structures.

21. The shade assembly as in claim 19, wherein said collapsed closed cell structures fold at a crease in said front face that defines said bottom edges, said crease defined at about the mid-point of said front face between said juncture lines.

22. The shade assembly as in claim 21, wherein said front face of said closed cell structures comprises a greater material length between said juncture lines than said back face, whereby in said expanded configuration of said shade assembly said front face droops below said juncture line of said closed cell structure with an immediately adjacent closed cell structure.

23. The shade assembly as in claim 19, further comprising a tab extending transversely from about at a mid-point of said back face of said closed cell structures at said attachment location of said lift cords, said lift cords running through said tabs.

24. The shade assembly as in claim 23, wherein each said closed cell structure is formed by a single piece of flexible material joined at edges to define a closed cell, said joined edges defining said tab.

25. The shade assembly as in claim 23, wherein said front face of said closed cell structures is formed from a first material piece, and said back face of said closed cell structures is formed from a separate second material piece, said tab defined by a folded section of said second material piece.

26. The shade assembly as in claim 25, wherein said first material piece and said second material piece are joined at said juncture lines to define a closed cell.

27. The shade assembly as in claim 25, wherein said first material piece is common to a plurality of said closed cell structures such that a single material piece defines said front faces for multiple closed cell structures.

28. The shade assembly as in claim 27, wherein said second material piece is common to a plurality of said closed cell structures such that a single material piece defines said back faces for multiple closed cell structures.

* * * * *